US008508939B2

(12) United States Patent
Takahasi et al.

(10) Patent No.: US 8,508,939 B2
(45) Date of Patent: Aug. 13, 2013

(54) FAN AND ELECTRONIC DEVICE EQUIPPED WITH THE SAME

(75) Inventors: Kazuyuki Takahasi, Osaka (JP); Tsutomu Koujitani, Fukuoka (JP); Syouji Kawashima, Saga (JP)

(73) Assignee: Panasonic Corporation, Osaka (JP)

( * ) Notice: Subject to any disclaimer, the term of this patent is extended or adjusted under 35 U.S.C. 154(b) by 295 days.

(21) Appl. No.: 12/991,991

(22) PCT Filed: May 15, 2008

(86) PCT No.: PCT/JP2008/001217

§ 371 (c)(1),
(2), (4) Date: Nov. 10, 2010

(87) PCT Pub. No.: WO2009/139023

PCT Pub. Date: Nov. 19, 2009

(65) Prior Publication Data

US 2011/0063799 A1 Mar. 17, 2011

(51) Int. Cl.
*H05K 7/20* (2006.01)
*F04D 29/54* (2006.01)

(52) U.S. Cl.
USPC ..... 361/695; 361/691; 361/692; 361/694; 361/679.49; 415/220; 454/186

(58) Field of Classification Search
USPC ..... 361/691, 692, 694, 695, 679.49; 165/80.3, 80.4, 104.34; 454/184–186; 700/299, 300; 415/220
See application file for complete search history.

(56) References Cited

U.S. PATENT DOCUMENTS 4,517,880 A * 5/1985 Buckner et al. ..... 454/184
4,699,208 A * 10/1987 Wolf et al. ..... 165/47
5,055,963 A * 10/1991 Partridge ..... 361/231

(Continued)

FOREIGN PATENT DOCUMENTS

JP 3-116799 12/1991
JP 5-44697 2/1993

(Continued)

OTHER PUBLICATIONS

Translation of the International Preliminary Report on Patentability together with Written Opinion issued Jan. 20, 2011 in International (PCT) Application No. PCT/JP2008/001217.

(Continued)

*Primary Examiner* — Anatoly Vortman
(74) *Attorney, Agent, or Firm* — Wenderoth, Lind & Ponack, L.L.P.

(57) ABSTRACT

A fan includes, an impeller having propeller-shaped blades, a motor disposed inside of a hub to rotationally drive the impeller centered on the rotation axis, a tubular air duct forming an air passage on a periphery of the blades of the impeller and the rotation axis, wherein the rotation axis penetrates the inside of the air duct, and an exhaust outlet larger than an outer diameter of a rotation trajectory of the blades is formed on one end of the air duct, and an air flow guiding plate blocking an opening on an other end of the air duct in the rotation axis direction, a suction inlet through which the rotation axis passes being formed in approximately the center of the air flow guiding plate, wherein the blades are closer to the air flow guiding plate than the air duct.

12 Claims, 21 Drawing Sheets

(56) References Cited

U.S. PATENT DOCUMENTS

| | | | | |
|---|---|---|---|---|
| 5,546,272 | A * | 8/1996 | Moss et al. | 361/679.48 |
| 5,566,377 | A * | 10/1996 | Lee | 361/695 |
| 5,630,469 | A * | 5/1997 | Butterbaugh et al. | 165/80.3 |
| 5,707,282 | A * | 1/1998 | Clements et al. | 454/184 |
| 5,914,858 | A * | 6/1999 | McKeen et al. | 361/695 |
| 6,011,216 | A * | 1/2000 | Kitahara et al. | 174/16.3 |
| 6,031,719 | A * | 2/2000 | Schmitt et al. | 361/695 |
| 6,343,011 | B1 * | 1/2002 | Yu | 361/695 |
| 6,396,688 | B1 * | 5/2002 | Davies et al. | 361/679.48 |
| 6,736,196 | B2 * | 5/2004 | Lai et al. | 165/122 |
| 6,826,048 | B1 * | 11/2004 | Dean et al. | 361/695 |
| 6,995,979 | B2 * | 2/2006 | Hsieh et al. | 361/695 |
| 7,177,149 | B2 * | 2/2007 | Lin | 361/695 |
| 7,184,265 | B2 * | 2/2007 | Kim et al. | 361/679.47 |
| 7,236,361 | B2 * | 6/2007 | Cote et al. | 361/695 |
| 7,304,844 | B2 * | 12/2007 | Jan et al. | 361/697 |
| 7,385,813 | B2 * | 6/2008 | Lin | 361/695 |
| 7,447,019 | B2 * | 11/2008 | Vinson et al. | 361/695 |
| 7,492,590 | B2 * | 2/2009 | Chen et al. | 361/695 |
| 7,654,309 | B2 * | 2/2010 | Wu et al. | 165/80.3 |
| 7,656,664 | B2 * | 2/2010 | Ye et al. | 361/695 |
| 7,835,149 | B2 * | 11/2010 | Li et al. | 361/679.49 |
| 2007/0137243 | A1 * | 6/2007 | Lee et al. | 62/419 |
| 2007/0189892 | A1 | 8/2007 | Oguma | |
| 2007/0286726 | A1 | 12/2007 | Yabuuchi | |
| 2009/0168330 | A1 * | 7/2009 | Li et al. | 361/679.47 |

FOREIGN PATENT DOCUMENTS

| | | | |
|---|---|---|---|
| JP | 6-4399 | | 1/1994 |
| JP | 2002-344182 | | 11/2002 |
| JP | 3094737 | | 4/2003 |
| JP | 2003-269393 | | 9/2003 |
| JP | 2004-239221 | | 8/2004 |
| JP | 2005-147018 | | 6/2005 |
| JP | 2006-77619 | | 3/2006 |
| JP | 2006-336523 | | 12/2006 |
| JP | 2007-218101 | | 8/2007 |
| JP | 2007-218150 | | 8/2007 |
| JP | 2008-14302 | | 1/2008 |
| JP | 2011166190 | A * | 8/2011 |
| WO | WO 2009144937 | A1 * | 12/2009 |

OTHER PUBLICATIONS

International Search Report issued Jun. 17, 2008 in International (PCT) Application No. PCT/JP2008/001217.

* cited by examiner

FAN AND ELECTRONIC DEVICE EQUIPPED WITH THE SAME

BACKGROUND OF THE INVENTION

I. Technical Field

The present invention is related to a fan which is disposed within a casing of an electronic device and discharges air within the casing to an outside of the casing, and also related to an electronic device in which the fan is mounted.

II. Description of the Related Art

Among various electronic devices, in those devices in which the amount of heat release within the device is large, a fan which discharges air within the device to the outside is generally mounted for cooling the inside. The majority of such fans are disposed near an inner surface of an outer wall of the electronic device in parallel with the inner surface. In recent years, many electronic devices equipped with a fan have been miniaturized or are thinner. Therefore, the space in which the fan is disposed has also become smaller. In other words, a gap between a portion of the fan on the suction side and parts, circuit boards, chassis, and the like mounted within the electronic device has become smaller.

However, as this gap becomes smaller, issues of an increase in noise and a reduction in air flow occur with conventional fans. In a conventional fan, if the portion of the fan on the suction side gets too close to the parts, circuit boards, chassis, and the like, an issue occurs in that an exhaust flow amount rapidly decreases.

The constitutions of a conventional fan and an electronic device equipped with such a fan will be explained below using FIGS. 24A to 26C.

FIG. 24A is a perspective view from the suction side of a conventional fan, and FIG. 24B is a perspective view from the exhaust side of a conventional fan. FIG. 25A is a plan view from the suction side of a conventional fan, and FIG. 25B is a plan view from the exhaust side of a conventional fan. FIG. 25C is a partial cross-section view taken along line Aa-Aa of the fan shown in FIG. 25A, and FIG. 25D is a partial cross-section view taken along line B-B of the fan shown in FIG. 25A. FIG. 26A is a plan view from the rear surface side of an electronic device equipped with a conventional fan. FIG. 26B is a partial cross-section view taken along line Ab-Ab of FIG. 26A, and FIG. 26C is a partially enlarged cross-section view of FIG. 26B. The outline of a blade 105 shown in FIGS. 25C, 25D, and 26C shows a rotation trajectory when the blade 105, is rotating.

First, the constitution of a conventional fan will be explained below.

In FIGS. 29A to 25D, a conventional fan 101 is generally called an axial flow fan, and the fan 101 mainly includes impeller 102 and a substantially rectangular casing 103. The impeller 102 includes a plurality of propeller-shaped blades 105, and a cylindrical hub 109 to which the blades 105 are attached. A motor 110 which rotates centered on a rotation axis 106 of the impeller 102 is mounted within the hub 109.

The motor 110 is supported by a motor-base 112. The motor-base 112 is connected and fixed to the casing 103 by four connecting strips 119*a* to 119*d*.

The casing 103 surrounds a periphery of the blades 105 and includes an inner wall which acts as an air duct. Tapered portions 107*a*, 107*b*, which are inclined such that their distance from the rotation axis 106 gradually expands towards the suction side, are formed on the inner wall of the casing 103 as shown in FIGS. 25C and 25D. As shown in FIG. 25A, the tapered portions 107*a* and the tapered portions 107*b* are each alternately provided at four locations on the inner wall. The tapered portions 107*a* are formed such that their inclination angle relative to the rotation axis 106 is larger than that of the tapered portions 107*b*. Tapered portions 106*a*, 106*b*, whose distance from the rotation axis 106 gradually expands towards the exhaust side, are formed on the inner wall of the casing 103 as shown in FIGS. 25C and 25D. As shown in FIG. 25B, the tapered portions 106*a* and the tapered portions 106*b* are each alternately provided at four locations on the inner wall. The tapered portions 106*a* are formed such that their inclination angle relative to the rotation axis 106 is larger than that of the tapered portions 106*b*. Cylindrical straight portions 108 are provided between the tapered portions 107*a* and the tapered portions 106*a*, and between the tapered portions 107*b* and the tapered portions 106*b*. Each of the straight portions 108 is disposed such that there is a slight gap between the straight portions 108 and an outer edge 109 that forms an outer periphery of the rotation trajectory of the blades 105. Mounting holes 150*a* to 150*d* for mounting other members are provided at the four corners of the fan 101.

Next, the constitution of an electronic device equipped with the conventional fan will be explained.

As shown in FIGS. 26A to 26C, an electronic device 124 includes a chassis 126, a circuit board 127, and a fan 101. A rear surface cover 130 engages with the chassis 126 and is fixed with a screw (not illustrated). The circuit board 127 is fixed to a boss (not illustrated) mounted upright on the chassis 126. An electronic component (not illustrated) is mounted on a mounting region 131 upon the circuit board 127. Four bosses (not illustrated) mounted upright on the chassis 126 are inserted into mounting holes 150*a* to 150*d* of the fan 101, and the portion of the fan 101 on the suction side is screw fixed so that it faces the chassis 126 in parallel.

A sponge 134 is attached in a gap between an outer periphery on the exhaust side of the casing 103 of the fan 101 and the rear surface cover 130 so that discharged air does not return to the inside of the electronic device 124 from the gap. A plurality of suction holes 132 and an exhaust holes 133 are provided in the shape of small circular holes on the rear surface cover 130.

In the electronic device 124 constituted as described above, the electronic component on the mounting region 131 of the circuit board 127 becomes a heat source and releases heat. This heat is transmitted to the air within the electronic device 124 from a front surface of the electronic component and a front surface of the circuit board 127.

Next, the air flow by the fan 101 mounted in the electronic component 124 will be explained. As shown in FIG. 26C, a distance in a height direction between an inner surface of the chassis 126 and the edge of the casing 103 on the suction side is defined as a suction distance h3, and a distance in a height direction from the inner surface of the chassis 126 to an inner surface of the rear surface cover 130 is defined as inner height h4.

First, the air flow in the case that the suction distance h3 is sufficiently large will be explained.

When the fan 101 rotates in the direction of arrow 111 shown in FIG. 24A, air is sucked in from the suction holes 132 shown in FIGS. 26A and 26B. The sucked air passes between the electronic component on the circuit board 127 or through a gap between the circuit board 127 and the chassis 126, and then flows to the vicinity of the portion of the casing 103 on the suction side. Afterwards, the air passes between the inner wall of the casing 103 and the hub 104, and is discharged from the exhaust holes 133.

However, in the electronic device 124 including the conventional fan 101, an exhaust flow amount of the fan 101 decreases as the suction distance h3 gets smaller, as shown by a dashed line in the graph of FIG. 27. In order to eliminate any influence from the circuit board 127, the dashed line in the graph of FIG. 27 shows an exhaust flow amount when the suction distance h3 shown in FIG. 26C is changed using a tester wherein the circuit board 127 was removed from the electronic device 124 shown in FIG. 26A.

In the conventional fan 101, as shown by the dashed line in FIG. 27, as the suction distance h3 becomes smaller, the exhaust flow amount decreases. When the suction distance h3 is 6 mm, the exhaust flow amount becomes zero. This phenomenon occurs because air flows in reverse from the exhaust holes 133 of the rear surface cover 130 and spiral flows 136 in which air flows to the outside again increase, as shown by arrows in FIG. 26C. Therefore, in the conventional fan 101, an issue arises in that obstructions such as the chassis 126, parts, and boards cannot be put greatly close to the portion on the suction side due to the reduction in the exhaust flow amount.

As another conventional example, a technology for improving the air flow of the fan is disclosed in, for example, Japanese Unexamined Utility Model Application No. H06-004399. Japanese Unexamined Utility Model Application No. H06-004399 discloses a fan which aims to increase the air flow by further enlarging the inclination angle of the tapered portions on the exhaust side of the fan toward the exhaust side.

As a further conventional example, a technology for improving the thinness of a fan is disclosed in, for example, Japanese Unexamined Patent Application No. H05-044697, Japanese Unexamined Patent Application No. H05-044697 discloses a circular cone-shaped mixed-flow fan in which a radius of an outer peripheral surface of a hub to which propeller-shaped blades of an impeller are attached increases towards the exhaust side.

As another conventional example, Japanese Unexamined Patent Application No. 2003-269393, for example, discloses using a centrifugal-type multiblade fan, and also discloses a fan using a centrifugal-type blade shape in which a suction inlet and an exhaust outlet are disposed in a front-rear relationship.

Patent Document 1: Japanese Unexamined Utility Model Application No. H06-004399

Patent Document 2: Japanese Unexamined Patent Application No. H05-044697

Patent Document 3: Japanese Unexamined Patent Application No. 2003-269393

SUMMARY OF THE INVENTION

However, in the fan of Japanese Unexamined Utility Model Application No. H06-004399, in the region in which the suction distance h3 is smaller than a radius of the blades 105, the air flow is only slightly larger than that of the conventional fan 101, and an issue arises in that the same phenomenon as that of the conventional fan 101 occurs, leading to a reduction in air flow.

Further, in the fan of Japanese Unexamined Patent Application No. H05-044697, a certain level of exhaust flow can be secured, even in the area in which the suction distance h3 is small. However, since the shape of the hub to which the blades are attached is a circular cone, in the case that the blades and hub are integrally resin molded using one group of dies having a simple constitution, an undercut may occur between the blades and the hub. Therefore, in the fan of Japanese Unexamined Patent Application No. H05-044697, there are issues in that resin molding is difficult, and it is necessary to attach the blades to the hub as separate members, and thus the cost becomes high.

In addition, in the fan of Japanese Unexamined Patent Application No. 2003-269393, since centrifugal-type blades are used, the air flow is less than other fans of the same size having propeller-shaped blades. Therefore, an issue arises in that, in the case that this fan is used in an electronic device in which the ventilation resistance is not so large, such a fan is not necessarily effective.

An objective of the present invention is to improve the above-mentioned issues of the prior art by providing a fan which can suppress a reduction in air flow and secure the necessary exhaust flow amount even in the case that obstructions such as a chassis, parts, and boards of an electronic device are disposed near the portion of the fan on the suction side, and an electronic device equipped with the fan.

In order to achieve to above object, the present invention provides the following configuration.

According to a first aspect of the present invention, there is provides a fan comprising:

an impeller to which a plurality of propeller-shaped blades are attached on a side surface of a substantially cylindrical hub centered on a rotation axis, a motor disposed inside of the hub, operable to rotationally drive the impeller centered on the rotation axis, a tubular air duct operable to form an air passage on a periphery of the blades of the impeller and the rotation axis, wherein the rotation axis penetrates the inside of the air duct, and an exhaust outlet which is larger than an outer diameter of a rotation trajectory of the blades is formed on one end of the air duct in a rotation axis direction, and an air flow guiding plate provided to block an opening on an other end of the air duct in the rotation axis direction, a suction inlet through which the rotation axis passes being formed in approximately a center of the air flow guiding plate, wherein the blades are closer to the air flow guiding plate than the air duct.

Propeller-shaped means a shape wherein the blades have a prescribed inclination relative to a flat surface orthogonal to the rotation axis. A suction inlet means an opening which is formed on the center of the air flow guiding plate and through which air enters. The exhaust outlet and the suction inlet are in a so-called front-rear relationship because the rotation axis is formed to pass through an inside of the exhaust outlet and the suction inlet. The motor disposed on an inside of the hub is not limited to one in which the entire motor is necessarily disposed on the inside of the hub. In other words, it is sufficient for part of the motor to be constituted on the inside of the hub.

The shape of the hub is expressed as substantially cylindrical because, when the hub is resin molded, in order to facilitate the removal of the hub from the die, a 0.5° to 4° draft angle can be given to a side surface of the hub, and because the hub may have a shape of a rotationally-balanced polygonal column.

According to the present embodiment, by the propeller-shaped blades, in addition to an air flow which is pushed out in the rotation axis direction, an air flow can be created which is pushed out in a centrifugal direction, which is a direction orthogonal to the rotation axis direction. Thereby, the static pressure can be greatly increased compared to conventional fans. Further, even in the case that obstructions such as a chassis, parts, and boards within the electronic device are disposed near the portion of the fan on the suction side, a reduction in exhaust flow can be suppressed, and the necessary exhaust flow amount can be secured.

According to a second aspect of the present invention, there is provided the fan as defined in the first aspect, wherein an inner diameter of the suction inlet formed on the air flow guiding plate is smaller than an outer diameter of the rotation trajectory of the blades and larger than an intermediate diameter of the outer diameter of the rotation trajectory of the blades and an outer diameter of the hub.

The inner diameter of the suction inlet means a diameter of the opening of the air flow guiding plate. The outer diameter of the hub means a diameter of the hub in the case that the shape of the hub is a cylinder, and means a diameter of the rotation trajectory in the case that the shape of the hub is a balanced polygonal column, and means an outermost diameter in the case that a draft angle is given to the side surface of the hub.

According to the above configuration, by the propeller-shaped blades, in addition to an air flow which is pushed out in the rotation axis direction, an air flow which is pushed out in the centrifugal direction, which is a direction orthogonal to the rotation axis direction, can be efficiently created. Thereby, the static pressure can be greatly increased compared to conventional fans. Further, even in the case that obstructions such as a chassis, parts, and boards within the electronic device are disposed near the portion of the fan on the suction side, a reduction in exhaust flow can be suppressed, and the necessary exhaust flow amount can be secured.

According to a third aspect of the present invention, there is provided the fan as defined in the first aspect, further comprising a motor-base operable to support the motor, and a plurality of connecting strips operable to connect and fix the motor-base to the air flow guiding plate, wherein the motor-base and the connecting strips are disposed on a portion of a suction inlet side in the rotation axis direction.

According to the above configuration, the blades of the fan can be brought toward the exhaust side by just a total distance of the thickness of the connecting strips and a gap between the connecting strips and the fan. Thereby, even if a distance between the portion of the fan on the suction side and the obstructions such as a chassis, parts, and boards is small, the air flow can be increased by just the total distance described above.

According to a fourth aspect of the present invention, there is provided the fan as defined in the third aspect, wherein one portion of the connecting strips and the motor-base are disposed to be spaced in the rotation axis direction further from the blades than the air flow guiding plate.

According to the above embodiment, since the motor-base and one portion of the connecting strips are positioned to be spaced further from the blades than the air flow guiding plate, the ventilation resistance due to the motor-base and the connecting strips can be reduced. Thereby, the air flow of the fan can be increased. Further, by disposing the motor-base to be spaced further from the blades than the air flow guiding plate, the installation space for the motor can be enlarged, and thus the size of the built-in parts of the motor can be increased. Thereby, since the torque of the motor can be increased, in the case that dust in the air gets clogged between the blades and the air flow guiding plate or between the blades and the air duct, the force for removing the dust can be increased. Thereby, conditions in which the fan cannot rotate can be suppressed.

According to a fifth aspect of the present invention, there is provided the fan as defined in the first aspect, wherein in a cross-section which is orthogonal to the rotation axis and cuts across an outer periphery of the rotation trajectory of the blades, the air duct has a first region which is near an outer edge of the blades which forms the outer periphery of the rotation trajectory, and a second region which is separated from the outer edge of the blades compared to the first region.

According to the above configuration, the air duct has the first and second regions, and in the first region where the blades and the air duct are near each other, the outer dimensions of the fan can be reduced, whereas in the second region, a broader air exhaust space of the fan that that in the first region can be secured. Therefore, for example, even if a fan is disposed in the narrow space of an electronic device, the exhaust resistance in the second region can be reduced, and in turn, the exhaust flow amount can be increased. Thereby, even if a distance between the portion of the fan on the suction side and the obstructions such as a chassis, parts, and boards is small, reductions in the air flow of the fan can be further suppressed, and the necessary air flow can be secured.

According to a sixth aspect of the present invention, there is provided the fan as defined in the first embodiment, wherein the air flow guiding plate is disposed in parallel with a flat surface orthogonal to the rotation axis.

Ribs are provided on the side of the air flow guiding plate facing the blades, and a gap between the ribs and the blades is smaller than a gap between the air duct and the blades. Thereby, the blades may be brought closer to the air flow guiding plate than the air duct.

According to the above configuration, the exhaust resistance of the fan can be reduced. Thereby, even if a distance between the portion of the fan on the exhaust side and the obstructions such as a chassis, parts, and boards is small, reductions in air flow of the fan can be further suppressed, and the necessary air flow can be secured.

According to a seventh aspect of the present invention, there is provided the fan as defined in the first aspect, wherein the air flow guiding plate has an inclined inner edge portion which inclines to approach the rotation axis as the air flow guiding plate separates from an exhaust side of the blades in the rotation axis direction, a chamfered portion which inclines corresponding to an inclination of the inclined inner edge portion is formed on the blades in a position facing an inner surface of the inclined inner edge portion, and the air flow guiding plate and the blades are formed such that a gap between the air flow guiding plate and the blades becomes smallest between the inclined inner edge portion and the chamfered portion.

According to the above configuration, the exhaust resistance of the fan can be reduced. Thereby, even if a distance between the part on the exhaust side of the fan and the obstructions such as a chassis, parts, and boards is small, reductions in air flow of the fan can be further suppressed, and the necessary air flow can be secured.

According to an eighth aspect of the present invention, there is provided the fan as defined in the first embodiment, wherein the plurality of blades are arranged such that the blades do not overlap with each other when viewed from the rotation axis direction.

According to the above configuration, since the plurality of blades are arranged such that they do not overlap with each other, the fan can be easily integrally molded (for example, by just drawing a die in one direction), and the impeller can be made cheaply.

According to a ninth aspect of the present invention, there is provided the fan as defined in the first aspect, wherein the outer edge of the blades which forms an outer periphery of the rotation trajectory is formed such that distance from the rotation axis expands from a suction inlet side toward an exhaust outlet side in the rotation axis direction.

According to the above configuration, since the effective area of the fan is expanded, the air flow of the fan can be increased in turn.

According to a tenth aspect of the present invention, there is provided the fan as defined in the fourth aspect, wherein the motor has a motor shaft for transmitting rotary force to the hub and a sliding bearing including oil for rotatably holding the motor shaft.

According to the above configuration, by disposing the motor-base such that it is spaced from the blades by only a prescribed amount beyond the air flow guiding plate, the installation space for the motor can be enlarged. Therefore, since the length of the sliding bearing built into the motor can be lengthened, the life of the sliding bearing can be extended.

According to an eleventh aspect of the present invention, there is provided the fan as defined in the first aspect, wherein a portion of the blades or hub on an exhaust outlet side in the rotation axis direction further comprises a disc attached centered on the rotation axis, a diameter of the disc being larger than an outer diameter of the hub and smaller than an outermost diameter of the rotation trajectory of the blades.

According to the above configuration, even if a distance between the portion of the fan on the suction side and the obstructions such as a chassis, parts, and boards is small, reverse flow of air discharged by the fan toward the vicinity of the blade roots of the blades can be suppressed by the disc. Thereby, the air flow of the fan can be increased.

According to a twelfth aspect of the present invention, there is provided an electronic device in which the fan as defined in any one of the first to tenth aspects is disposed and built in near an outer wall, wherein in the outer wall, exhaust holes operable to discharge air from the fan are formed in a region on an outside of a regulation circle which has a diameter that is larger than the outer diameter of the hub and smaller than the exhaust outlet, centered on a position corresponding to the rotation axis of the fan.

According to the above configuration, even if a distance between the portion of the fan on the suction side and the obstructions such as a chassis, parts, and boards is small, by not providing the exhaust holes on the inside of the regulation circle, reverse flow of air discharged by the fan toward the vicinity of the blade roots of the blades can be suppressed. Thereby, the air flow of the fan can be increased.

According to a thirteenth aspect of the present invention, there is provided an electronic device in which the fan as defined in the eleventh embodiment is disposed and built in an outer wall, wherein in the outer wall, exhaust holes operable to discharge air from the fan are formed in a region opposite to the exhaust outlet of the fan.

According to the above configuration, since the fan includes the disc on a portion of the blades or hub on the exhaust outlet side, even if a distance between the portion of the fan on the suction side and the obstructions such as a chassis, parts, and boards is small, reverse flow of air discharged by the fan toward the vicinity of the blade roots of the blades can be suppressed. Thereby, since reverse flow of air from the exhaust holes of the electronic device can be suppressed, the air flow of the fan can be increased in turn.

According to a fourteenth aspect of the present invention, there is provided an electronic device in which the fan as defined in any one of the first to tenth aspects is disposed and built in near an outer wall, wherein in the outer wall, exhaust holes operable to discharge air from the fan are formed in a region opposite to the exhaust outlet of the fan.

According to the above configuration, by the propeller-shaped blades, in addition to an air flow which is pushed out in the rotation axis direction, an air flow can be created which is pushed out in the centrifugal direction, which is a direction orthogonal to the rotation axis direction. Thereby, the static pressure can be greatly increased compared to conventional fans. Further, even in the case that obstructions such as a chassis, parts, and boards within the electronic device are disposed near the portion of the fan on the suction side, a reduction in exhaust flow can be suppressed, and the necessary exhaust flow amount can be secured.

According to the fan of the present invention, since a gap between the blades and the air duct is constituted to be bigger than a gap of the air flow guiding plate, by the propeller-shaped blades, in addition to an air flow which is pushed out in the rotation axis direction, an air flow which is pushed out in the centrifugal direction can be created in the gap between the blades and the air duct. Thereby, the static pressure can be greatly increased compared to conventional fans. Further, even in the case that obstructions such as a chassis, parts, and boards within the electronic device are disposed near the portion of the fan on the suction side, a reduction in exhaust flow can be suppressed, and the necessary exhaust flow amount can be secured. In addition, since the exhaust outlet and the suction inlet are formed such that the rotation axis passes through their insides, i.e. since the exhaust outlet and the suction inlet are in a front-rear relationship, air which is sucked in from the suction inlet can be discharged to the exhaust outlet on the rear side.

BRIEF DESCRIPTION OF THE DRAWINGS

These and other aspects and features of the present invention will become clear from the following description taken in conjunction with the preferred embodiments thereof reference to the accompanying drawings, in which.

DETAILED DESCRIPTION OF THE INVENTION

Figure 1A:
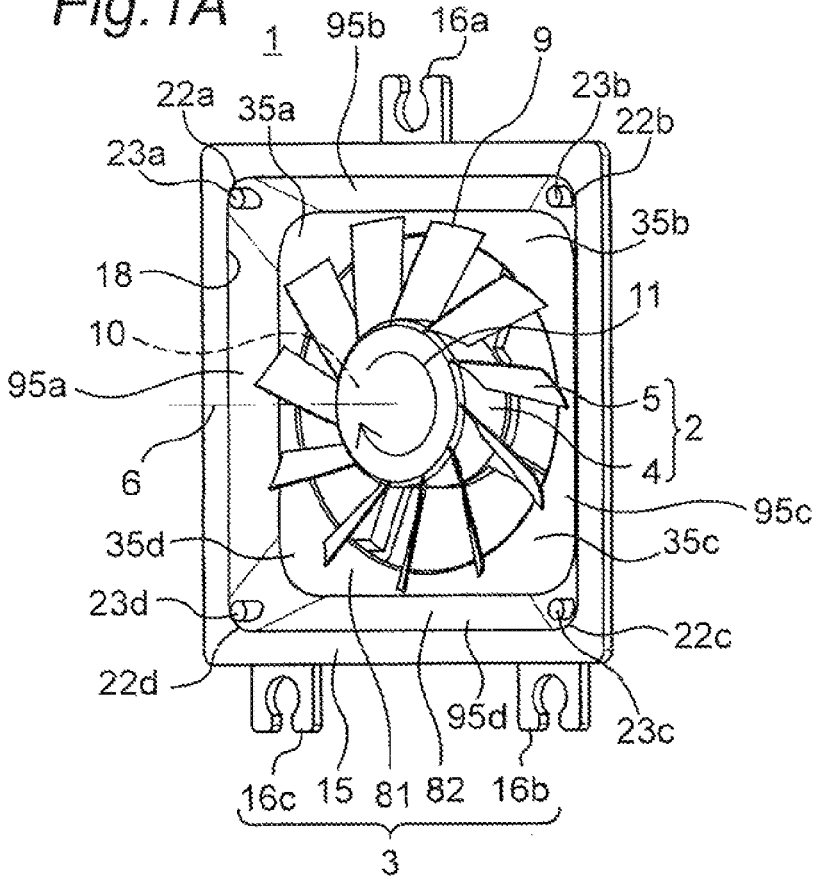
FIG. 1A is a perspective view of the fan according to a first embodiment of the present invention when viewed from the exhaust side.

Before continuing with the description of the present invention, note that in the attached drawings, parts which are the same are labeled with the same reference numeral.

The embodiments of the present invention will be explained below while referring to the drawings.

First Embodiment

The fan according to a first embodiment of the present invention and an electronic device equipped with this fan will be explained using FIGS. 1A to 12.

Figure 1B:
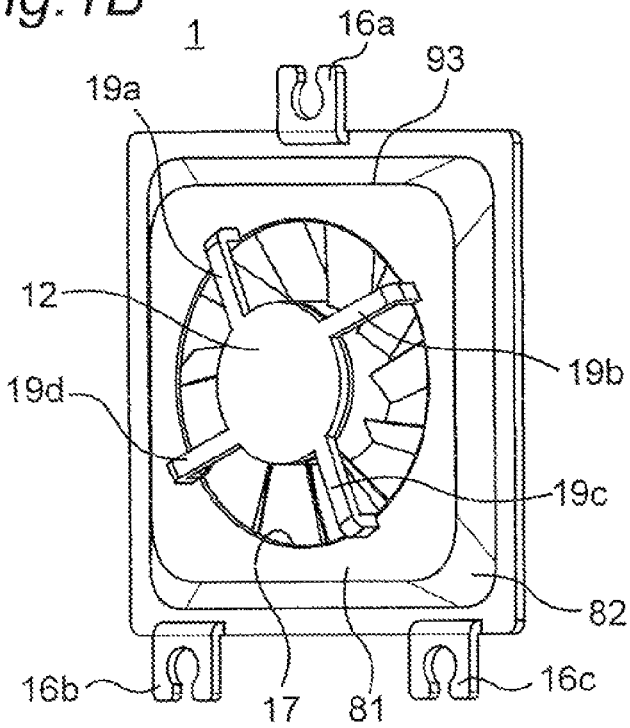
FIG. 1B is a perspective view of the fan according to a first embodiment of the present invention when viewed from the suction side.
Figure 2A:
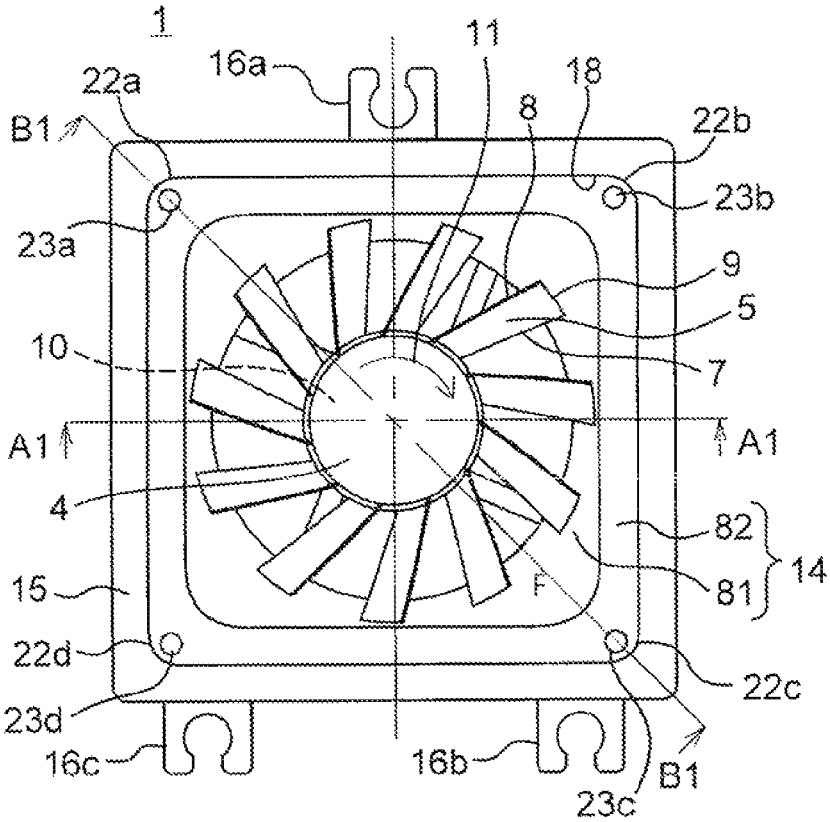
FIG. 2A is a plan view of the fan according to a first embodiment of the present invention when viewed from the exhaust side.
Figure 2B:
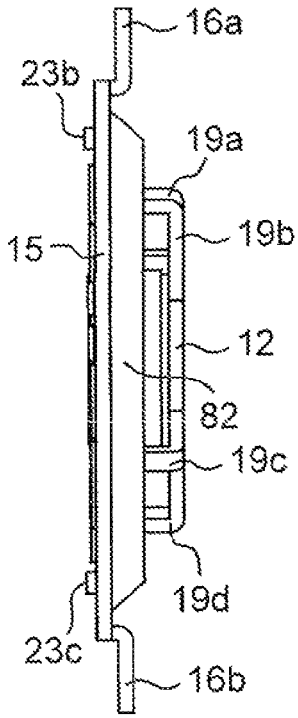
FIG. 2B is a right-side surface view of the fan shown in FIG. 2A.
Figure 2C:
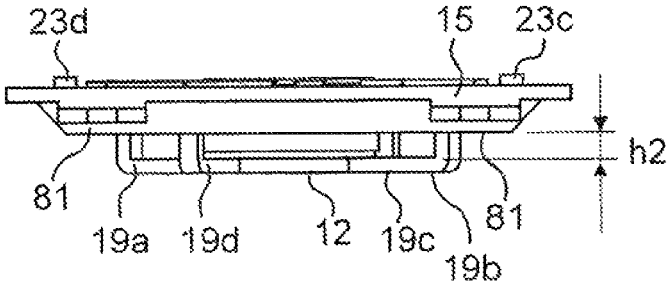
FIG. 2C is a bottom-side surface view of the fan shown in FIG. 2A.
Figure 2D:
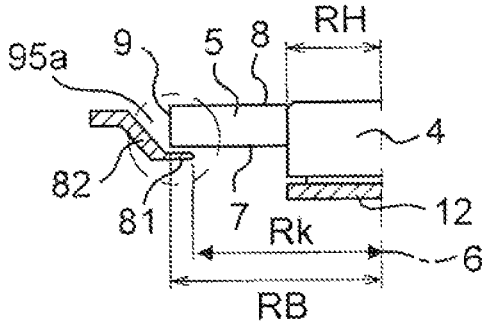
FIG. 2D is a partial cross-section view taken along line A1-A1 of the fan shown in FIG. 2A.
Figure 2E:
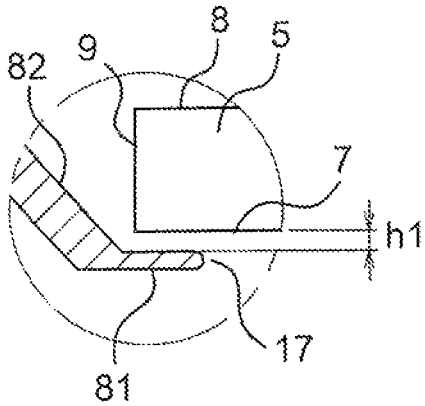
FIG. 2E is a partially enlarged cross-section view of FIG. 2D.
Figure 2F:
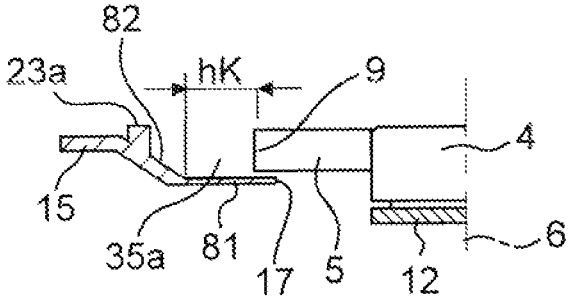
FIG. 2F is a partial cross-section view taken along line B1-B1 of the fan shown in FIG. 2A.
Figure 3:
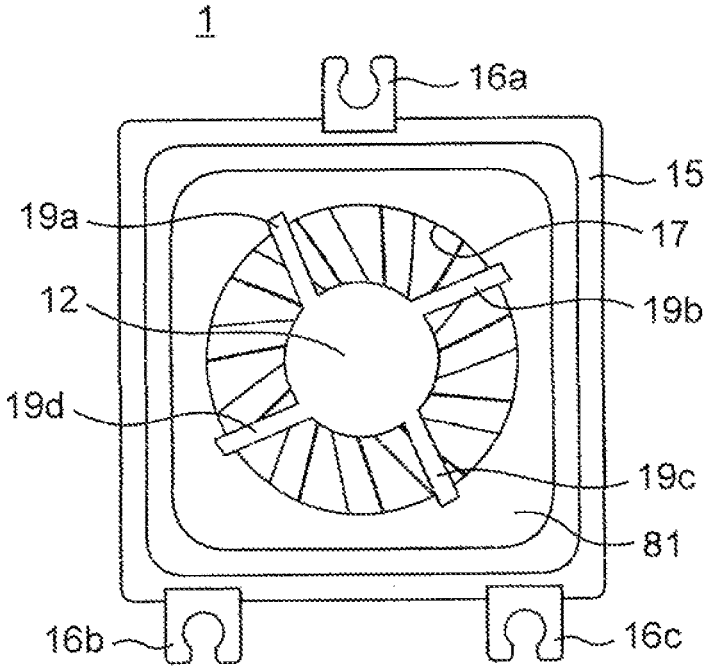
FIG. 3 is a plan view of the fan according to a first embodiment of the present invention when viewed from the suction side.
Figure 4A:
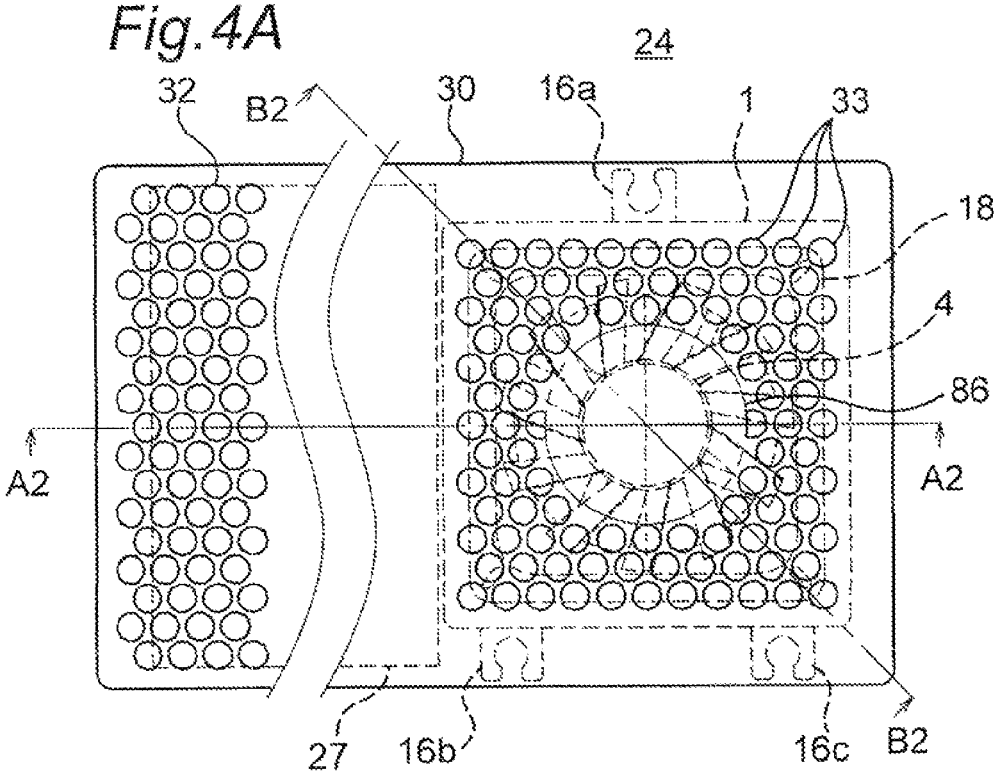
FIG. 4A is a plan view of an electronic device equipped with the fan according to a first embodiment of the present invention.
Figure 4B:
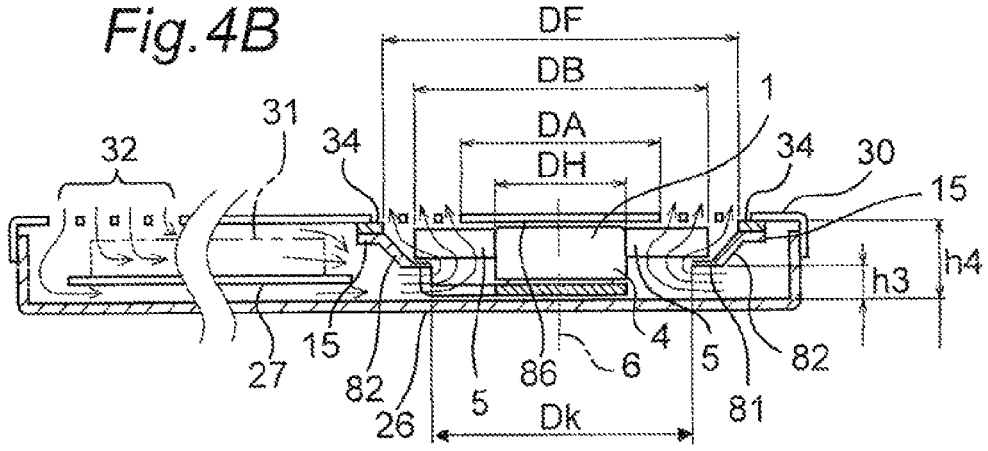
FIG. 4B is a partial cross-section view taken along line A2-A2 of the electronic device shown in FIG. 4A.
Figure 4C:
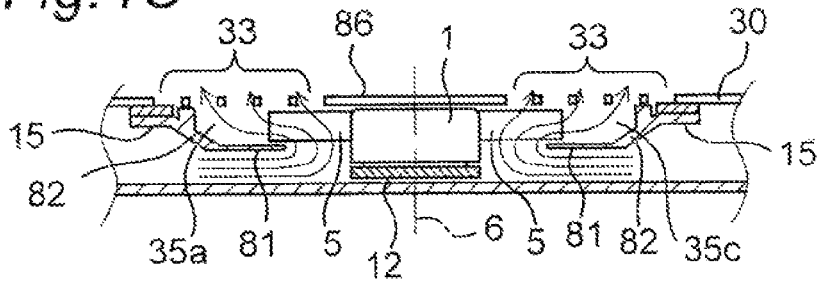
FIG. 4C is a partial cross-section view taken along line B2-B2 of the electronic device shown in FIG. 4A.

FIG. 1A is a perspective view of the fan according to the first embodiment of the present invention when viewed from the exhaust side, and FIG. 1B is a perspective view of the fan when viewed from the suction side. FIG. 2A is a plan view of the fan according to the first embodiment of the present invention when viewed from the exhaust side; FIG. 2B is a right-side surface view of the fan shown in FIG. 2A; FIG. 2C is a bottom-side surface view of the fan shown in FIG. 2A; FIG. 2D is a partial cross-section view taken along line A1-A1 of the fan shown in FIG. 2A; FIG. 2E is a partially enlarged cross-section view of FIG. 2D; and FIG. 2F is a partial cross-section view taken along line B1-B1 of the fan shown in FIG. 2A. The outline of the blade 5 shown in FIGS. 2D, 2E, and 2F shows a rotation trajectory when the blade 5 is rotating. FIG. 3 is a plan view of the fan according to the first embodiment of the present invention when viewed from the suction side. FIG. 4A is a plan view of an electronic device equipped with the fan according to the first embodiment of the present invention. FIG. 4B is a partial cross-section view taken along line A2-A2 of FIG. 4A, and FIG. 4C is a partial cross-section view taken along line B2-B2 of FIG. 4A.

The constitution of a fan 1 according to the first embodiment of the present invention will be explained below.

In FIGS. 1 to 3, the fan 1 mainly includes an impeller 2 and a substantially rectangular casing 3.

The impeller 2 includes a plurality of propeller-shaped blades 5 and a substantially cylindrical hub to which the blades 5 are attached on a side surface. The center of the hub 4 is positioned on a rotation axis 6 of the fan 1. The propeller-shaped blades 5 are attached so that they are inclined in a range of 15° to 70° in a direction of the exhaust side of the rotation axis 6 relative to a flat surface of the impeller 2 orthogonal to the rotation axis 6. Preferably, the inclination angle of the blades 5 is set to be an optimal value so the air flow is at its maximum. The blades 5 are arranged such that they do not overlap with each other when viewed from the direction of the rotation axis 6. Thereby, when making the impeller 2 using a die, the impeller 2 can be made by a simple process of merely drawing the die in a direction parallel to the rotation axis 6. In order to facilitate the removal of the die, an approximately 0.5° to 4° draft angle is imparted to the side surface of the hub 4.

A motor 10 is stored inside the hub 4 coaxially with the rotation axis 6 of the impeller 2. The motor 10 rotationally drives the impeller 2 in a direction shown by arrow 11 in FIGS. 1A and 2A.

The motor 10 is supported by a motor-base 12. Within the motor 10, a motor shaft which transmits rotary force to the hub 4 and a sliding bearing (not illustrated) including oil which rotatably holds the motor shaft are built in. A circuit board (not illustrated) controlling the rotation of the blades 5 is disposed between the motor-base 12 and the motor 10.

As shown in FIG. 2A, the blades 5 of the impeller 2 include a front edge 7 which is positioned on the suction side and forms a front side in a rotation direction 11, a back edge 8 which is positioned on the exhaust side and forms a back side in the rotation direction 11, and an outer edge 9 which is positioned between the front edge 7 and the back edge 8 and forms an outer shape (outer periphery) of the rotation trajectory of the blades 5.

As shown in FIG. 2D, the front edge 7 and the back edge 8 of the blades 5 are formed to be substantially parallel to a flat surface orthogonal to the rotation axis 6. The outer edge 9 of the blades 5 is formed to be substantially parallel to the rotation axis 6.

As shown in FIG. 1A, the casing 3 includes an air flow guiding plate 81, an air duct 82, a flange portion 15, and fixing arms 16*a*, 16*b*, 16*c*.

The air duct 82 is a tubular member having fillets attached at the four corners of a regular truncated pyramid, and the air duct 82 surrounds the periphery of the blades 5 and the rotation axis 6 of the impeller 2 to form an air passage. An exhaust outlet 18 which is larger than the outer diameter of the rotation trajectory of the blades 5 is formed on the end of the air duct 82 on the exhaust side. The exhaust outlet 18 is formed such that the rotation axis 6 passes through the inside thereof. The air duct 82 has a suction-side peripheral edge portion 93 on the end of the suction side.

The air duct 82 is formed such that its distance from the rotation axis 6 gradually expands from the suction side to the exhaust side. The flange portion 15 is formed parallel to a flat surface which is orthogonal to the rotation axis 6 on the periphery of the exhaust outlet 18 of the air duct 82. Fixing arms 16*a* to 16*c* are formed on the outside of the flange portion 15 for fixing other members to the fan 1.

The flat plate-shaped air flow guiding plate 81 is formed on the suction-side peripheral edge portion 93 of the air duct 82 to block an opening on the suction-side end of the air duct 82. The air flow guiding plate 81 is disposed parallel to a flat surface which is orthogonal to the rotation axis 6. A circular suction inlet 17 is provided at approximately the center of the air flow guiding plate 81. The center of the suction inlet 17 is positioned on the rotation axis 6.

As shown in FIGS. 2D and 2E, the air flow guiding plate 81 is formed to be facing the front edge 7 of the blades 5. The blades 5 are closer to the air flow guiding plate 81 than the air duct 82. In other words, a gap h1, which is a gap between the front edge 7 of the blades 5 and the portion of the air flow guiding plate 81 which is near the suction inlet, is formed to be smaller than a gap between the outer edge 9 of the blades 5 and the air duct 82. Thereby, reverse flow of air from the exhaust outlet 18 to the suction inlet 17 can be prevented.

Considering the run out of the impeller 2, the parts assembly tolerance, deformations due to thermal expansion, locking of the rotation of the impeller 2 due to adherence of dust in the air, mass production margin, and the like, the gap h1 is preferably set to be the minimum value at which the air flow guiding plate 81 and the front edge 7 of the blades 5 do not contact each other.

The suction inlet 17 and the exhaust outlet 18 are formed to be parallel to a flat surface which is orthogonal to the rotation axis 6. The suction inlet 17 and the exhaust outlet 18 are in a front-rear relationship. Here, the exhaust outlet 18 is set to be substantially parallel to a flat surface which is orthogonal to the rotation axis 6, but it can also be set to be inclined relative to a flat surface orthogonal to the rotation axis 6.

If a radius Rk of the suction inlet 17 is too small, the opening area of the suction inlet 17 becomes too small and thus the air flow decreases. On the other hand, if the radius Rk of the suction inlet 17 is too large, when an obstruction is placed near the suction inlet 17, an exhaust flow amount decreases because the centrifugal component of the air within the fan 1 cannot be generated in a large amount. Therefore, the radius Rk of the suction inlet 17 has a point within a range in which it is not too small and not too large at which the maximum air flow is generated. Specifically, the optimal value for an inner diameter of the suction inlet 17 is considered to be within a range in which it is smaller than the outer diameter of the rotation trajectory of the blades 5 and larger than an intermediate diameter of the outer diameter of the rotation trajectory of the blades 5 and the outer diameter of the hub 4.

Therefore, as shown in FIGS. 2D and 2E, the radius Rk of the suction inlet 17 is set to be smaller than a radius RB of the rotation trajectory of the blades 5 and larger than an intermediate radius (RB+RH)/2 of the outer diameter of the rotation trajectory of the blades 5 and the outer diameter of the hub 4. When represented by a relational expression, Rk is expressed by the following formula (1).

$$(RB+RH)/2<RK<RB \quad (1)$$

In the case that the fan 1 is built into an electronic device 24, it is preferable to adjust the radius Rk of the inner diameter of the suction inlet 17 to an optimal value within the above range in accordance with the ventilation resistance of the electronic device.

The motor-base 12 is disposed on a portion of the fan 1 on the suction inlet 17 side in the rotation axis direction. The motor-base 12 is connected and fixed to the air flow guiding plate 81 by four connecting strips 19*a* to 19*d*. As shown in FIG. 2C, the motor-base 12 and the connecting strips 19*a* to 19*d* are arranged to be spaced from the blades 5 in the rotation axis direction by just a distance h2 from the air flow guiding plate 81. The lower limit value of the distance h2 is set to be larger than zero. On the other hand, when the fan 1 is built into the electronic device 24, the upper limit value of the distance h2 is set such that the motor-base 12 and the connecting strips 19*a* to 19*d* do not contact the members within the electronic device 24 when a space in which the fan 1 can generate a necessary amount of exhaust flow is provided on the suction side of the fan 1. The distance h2 is preferably set to be as large as possible within the range of from the lower limit value to the upper limit value in order to reduce noise and ventilation resistance. Here, four connecting strips are provided, but two connecting strips may be provided as long as the strength and air resistance satisfy the performance requirements. In other words, there may be two or more connecting strips.

An inner surface of an inclined surface portion of the regular truncated pyramid of the air duct 82 is near the outer edge 9 of the blades 5. In a cross-section of the air duct 82 which is orthogonal to the rotation axis 6 and cuts across the outer periphery of the rotation trajectory of the blades 5, the air duct 82 has a first region which is near the outer edge 9 of the blades 5, and a second region which is separated from the outer edge 9 of the blades 5 compared to the first region. As shown in FIGS. 1A and 2D, spaces 95*a* to 95*d* are formed between the first region and the outer edge 9 of the blades 5.

The exhaust outlet 18 is formed in a substantially square shape having fillets 22*a* to 22*d* in its four corners. As shown in FIGS. 1A and 2F, spaces 35*a* to 35*d* are formed near the fillets 22*a* to 22*d*. The spaces 35*a* to 35*d* are each formed between the second region of the air duct 82 and the outer edge 9 of the blades 5. A distance hK between a contact point of the air duct 82 and the air flow guiding plate 81 in a direction orthogonal to the rotation axis 6 and the outer edge 9 of the blades 5 is, for example, set to be ⅓ or more of a distance which is the difference between the radius Rk of the suction inlet 17 and the radius RH of the hub 4 in a direction orthogonal to the rotation axis 6. In other words, the width of the spaces 35*a* to 35*d* in a direction orthogonal to the rotation axis 6 is ⅓ or more of the distance which is the difference between the radius Rk of the suction inlet 17 and the radius RH of the hub 4. Thereby, air which is sucked into the fan 1 from the suction inlet 17 can be efficiently discharged to the outside of the fan 1 from the exhaust outlet 18.

Protection bosses 23*a* to 23*d* are provided upright on each inner surface of the air duct 82 near the fillets 22*a* to 22*d*. The protective bosses 23*a* to 23*d* are formed to project out on the exhaust side (the top side in FIG. 2F) in the rotation axis direction farther than the impeller 2. Thereby, when the fan 1 is placed on a flat surface such as a desk with the exhaust side portion facing down, the blades 5 do not contact the flat surface. Therefore, breakage of the blades 5 can be prevented.

Next, the constitution of the electronic device 24 equipped with the fan 1 according to the first embodiment of the present invention will be explained using FIGS. 4A to 4C.

FIG. 4A is a plan view of an electronic device equipped with the fan according to the first embodiment of the present invention. FIG. 4B is a partial cross-section view taken along line A2-A2 of the electronic device shown in FIG. 4A, and FIG. 4C is a partial cross-section view taken along line B2-B2 of the electronic device shown in FIG. 4A.

As shown in FIGS. 4A to 4C, the electronic device 24 includes the fan 1, a chassis 26, a rear surface cover 30, and a circuit board 27. The rear surface cover 30 engages with the chassis 26 and is fixed with a screw. The casing of the electronic device 24 is constituted by the chassis 26 and the rear surface cover 30. In other words, the rear surface cover 30 constitutes a portion of the outer wall of the electronic device 24. The circuit board 27 is fixed to a boss (not illustrated) mounted upright on the chassis 26. An electronic component is mounted on a mounting region 31 upon the circuit board 27.

The fan 1 is attached to the inside of the electronic device 24 by attaching the fixing arms 16*a* to 16*c* to the bosses (riot illustrated) mounted upright on the chassis 26 so that the portion of the fan 1 on the suction side is facing the chassis 26 in a substantially parallel manner. Hereinafter, a distance between the chassis 26 and the air flow guiding plate 81 of the fan 1 will be defined as suction distance h3, and a distance from the chassis 26 to an inner surface of the rear surface cover 30 will be defined as inner height h4.

The fan 1 is disposed such that the exhaust outlet 18 is positioned near the rear surface cover 30 and is parallel to the rear surface cover 30. An annular sponge 34 is attached in the gap between the flange portion 15 of the fan 1 and the rear surface cover 30. Air which is discharged to the outside of the electronic device 24 is prevented from returning to the inside of the electronic device 24 from the above-described gap by the sponge 34.

A plurality of suction holes 32 and exhaust holes 33 are provided in the shape of small circular holes on the rear surface cover 30. As shown in FIG. 4A, the exhaust holes 33 are disposed between a regulation circle 86 and a region facing the exhaust outlet 18 of the fan 1. As shown in FIG. 4B, the regulation circle 86 is formed centered on the rotation axis 6 and with a diameter which is larger than an outer diameter DH of the hub 4 and smaller than the exhaust outlet 18. Basically, in FIG. 4B, the regulation circle 86 is formed with a diameter which is smaller than a minimum width DF of the exhaust outlet 18 in a direction orthogonal to the rotation axis 6. Thereby, a flow of air from the outside of the electronic device 24 can be prevented from flowing inside near the side of the hub 4 and between the adjacent blades 5, 5, and thus a reduction in exhaust flow amount can be prevented.

If the ventilation resistance of the inside of the electronic device 24 is large, a diameter DA of the regulation circle 86 is preferably set large, and if the ventilation resistance is small, the diameter DA is preferably set small. By setting the diameter DA in this way, since the air flow is increased in turn, the optimal value is adjusted and set by the ventilation resistance.

Figure 5A:
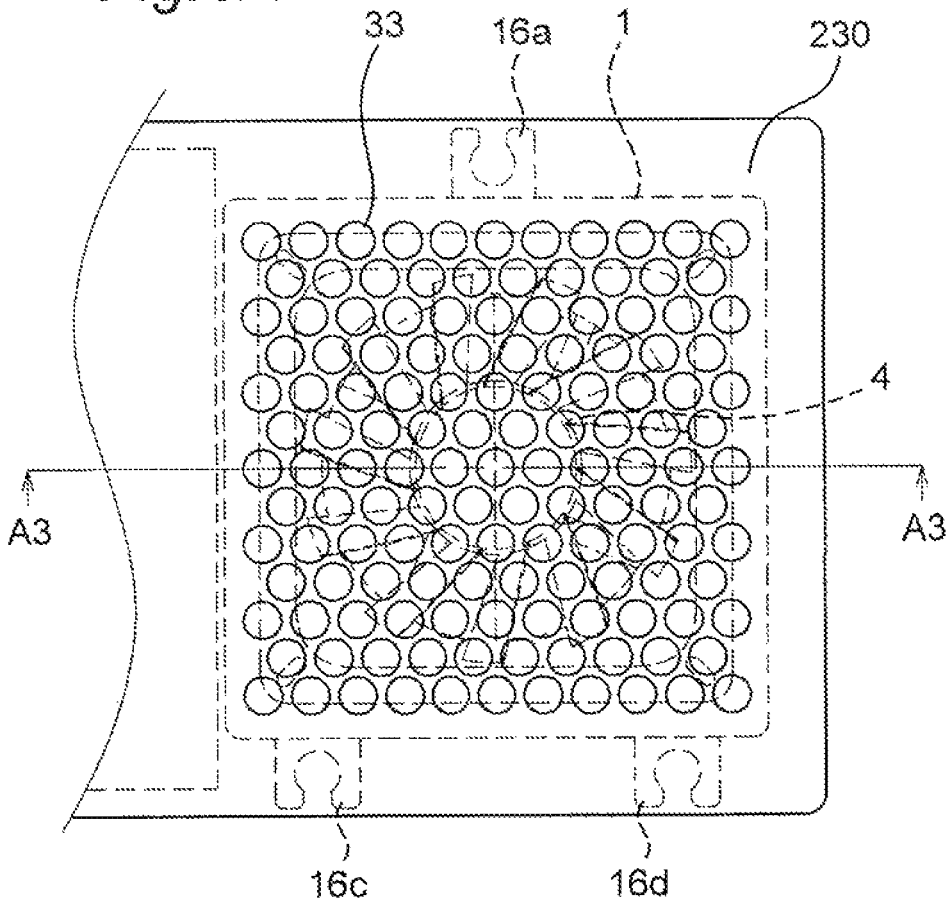
FIG. 5A is a plan view of an electronic device which is a comparative example of the electronic device shown in FIG. 4A.
Figure 5B:
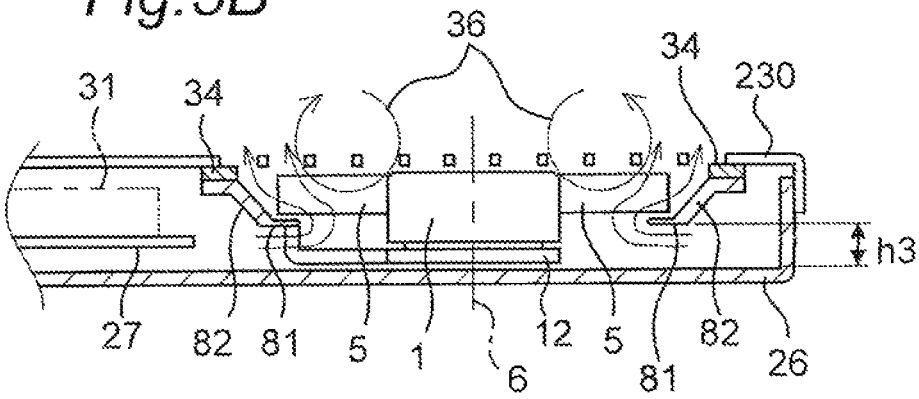
FIG. 5B is a partial cross-section view of the electronic device shown in FIG. 5A.

As a comparative example of the electronic device 24 constituted as described above, an electronic device including a rear surface cover 230 in place of the rear surface cover 30 is shown in FIGS. 5A and 5B. The rear surface cover 230 is different from the rear surface cover 30 in that exhaust holes 33 are provided inside the regulation circle 86 as well. If exhaust holes 33 exist in this part, as shown in FIG. 5B, spiral flows 36 are generated, and the exhaust flow amount may decrease. The spiral flows 36 are air flows in which air flows from outside of the casing of the electronic device through the exhaust holes 33 to the vicinity of a side surface of the hub 4, which is the root of the blades 5, and then flows through the exhaust holes 33 again to the outside of the casing. The spiral flows 36 are particularly easily generated when the suction distance h3 is small and the ventilation resistance of the inside of the electronic device 24 is large. Therefore, in the first embodiment of the present invention, in order to prevent the occurrence of the spiral flows 36, a rear surface cover 30 in which no exhaust holes 33 are provided on the inside of the regulation circle 86 is used.

Although the spiral flows 36 do occur even with the exhaust holes 33 of the rear surface cover 230 in FIG. 5A, since a certain amount of exhaust is possible by the fan 1, the exhaust holes 33 can be provided on the inside of the regulation circle 86. In particular, when the ventilation resistance of the inside of the electronic device is small, no major effects are achieved by not providing the exhaust holes 33 on the inside of the regulation circle 86. Therefore, the exhaust holes 33 can be provided on the inside of the regulation circle 86 as well, and exhaust is possible even with exhaust holes 33, which are unrelated to the regulation circle 86, corresponding to the exhaust outlet 18 of the fan 1.

Next, the flow of air (air flow) of the electronic device 24 will be explained.

First, when the fan 1 rotatably drives, as shown by the arrows in FIGS. 4B and 4C, the air outside of the electronic device 24 is sucked into the inside of the electronic device 24 from the suction holes 32. The sucked airflows through the electronic component or through a gap between the circuit board 27 and the chassis 26 to the periphery of the air flow guiding plate 81 of the fan 1. The air which has flowed to the periphery of the air flow guiding plate 81 is led by the air flow guiding plate 81 to pass through the suction inlet 17, then the air passes through the inside of the air duct 82 and is discharged from the exhaust holes 33. Using this flow of air, heat which has been generated by the electronic component is released to the outside of the electronic device 24.

Figure 6:
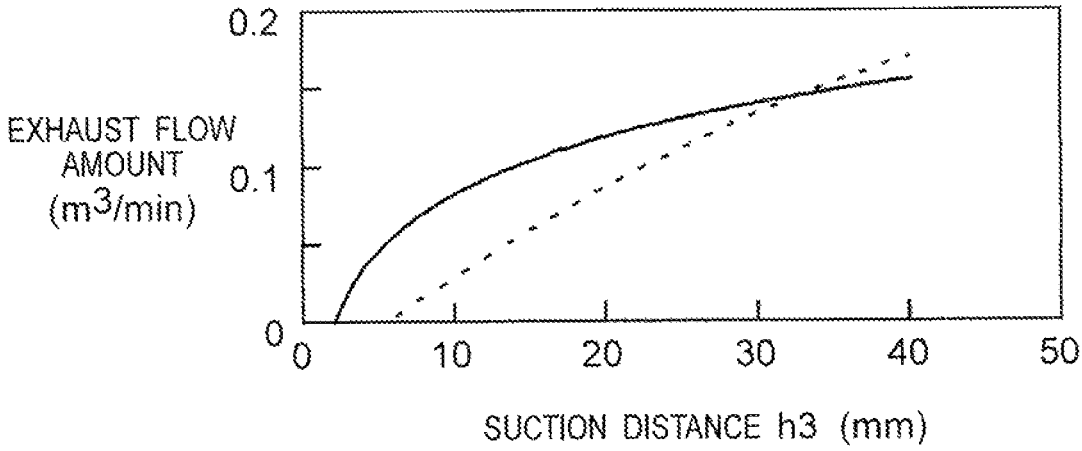
FIG. 6 is a graph showing the relationship between a suction air distance and an exhaust flow amount.

Next, the results of tests to measure an exhaust flow amount of the fan 1 according to the first embodiment of the preset invention and that of the conventional fan 101 will be explained using FIG. 6. FIG. 6 is a graph showing the relationship between the suction distance h3 and the exhaust flow amount. In FIG. 6, the solid line shows the exhaust flow amount of the fan 1, and the dashed line shows the exhaust flow amount of the conventional fan 101.

Figure 26A:
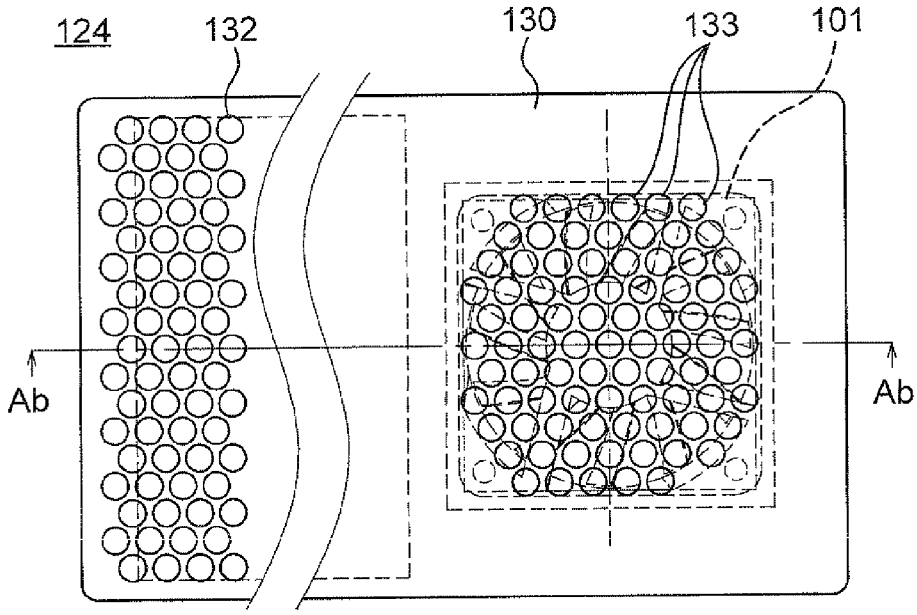
PRIOR ART Fig.26A
FIG. 26A is a plan view of an electronic device equipped with a conventional fan when viewed from the rear surface side.
Figure 26B:
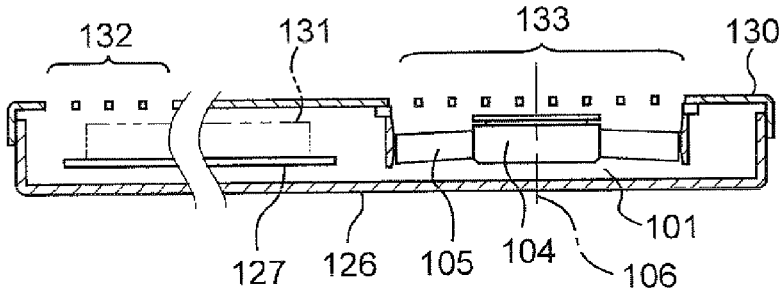
PRIOR ART Fig.26B
FIG. 26B is a partial cross-section view taken along line Ab-Ab of the electronic device shown in FIG. 26A.
Figure 26C:
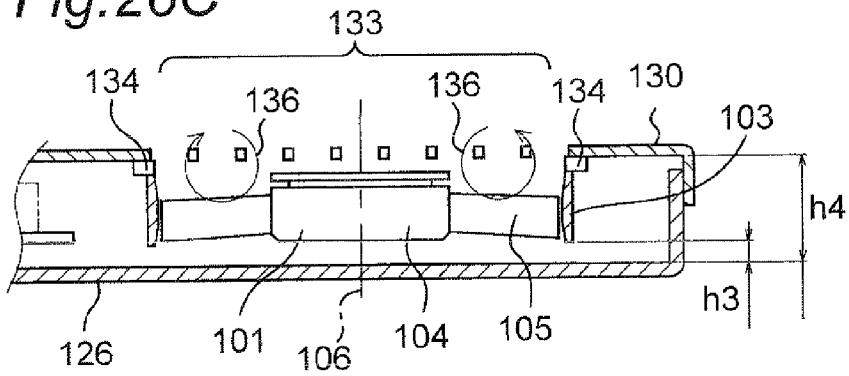
PRIOR ART Fig.26C
FIG. 26C is a partially enlarged cross-section view of FIG. 26B.
Figure 27:
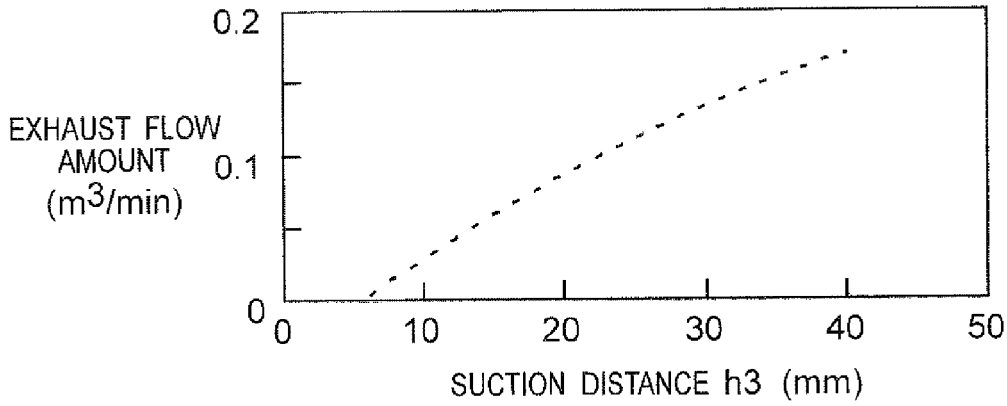
PRIOR ART Fig.27
FIG. 27 is a graph showing the relationship between a suction air distance and an exhaust flow amount of a conventional fan.

The test of the fan 1 was carried out in a state in which the fan 1 is disposed inside of the electronic device 24, as shown in FIGS. 4A to 4C. Further, the test of the conventional fan 101 was carried out in a state in which the fan 101 is disposed inside the electronic device 124, as shown in FIGS. 26A to 26C. The insides of the electronic devices 24, 124 were in an empty state, in which the electronic component and the circuit board 27 were not disposed. The horizontal and vertical external sizes of the electronic devices 24, 124 were the same. The distances between the rear surface covers 30, 130 and the portion of the casings 3, 103 of the fans 1, 101 on the exhaust side were identical and fixed. In the fans 1, 101, the widths in the rotation axis direction, outer diameters, blade numbers, and rotation numbers of the blades 5, 105 of the impellers 2, 102 were identical and fixed. In the rear surface covers 30, 130, the suction holes 32, 132 had the same shape, and the exhaust holes 33, 133 had the hole shapes shown in FIGS. 4A and 26A, respectively. In order to measure the exhaust flow amount when the suction distance h3 is changed, the measurements were taken upon changing the inner heights h4, which are the distances between the rear surface covers 30, 130 and the chassis 26, 126.

As shown in FIG. 6, when the suction distance h3 was 33 mm or less, the exhaust flow amount of the fan 1 could be increased compared to the exhaust flow amount of the conventional fan 101. In the conventional fan 101, when the suction distance h3 was 6 mm, the exhaust flow amount became zero. In contrast, in the fan 1, even when the suction distance was 6 mm, an exhaust flow amount corresponding to the exhaust flow amount in the conventional fan 101 when the suction distance h3 was 14 mm could be generated.

In this way, the fan 1 according to the first embodiment of the present invention can increase the exhaust flow amount when the suction distance h3 is approximately 33 mm or less, compared to the conventional fan 101. For example, when the suction distance h3 of the fan 1 is 10 mm, an exhaust flow amount which is equivalent to that of the conventional fan 101 when the suction distance h3 is 20 mm can be generated.

Figure 7:
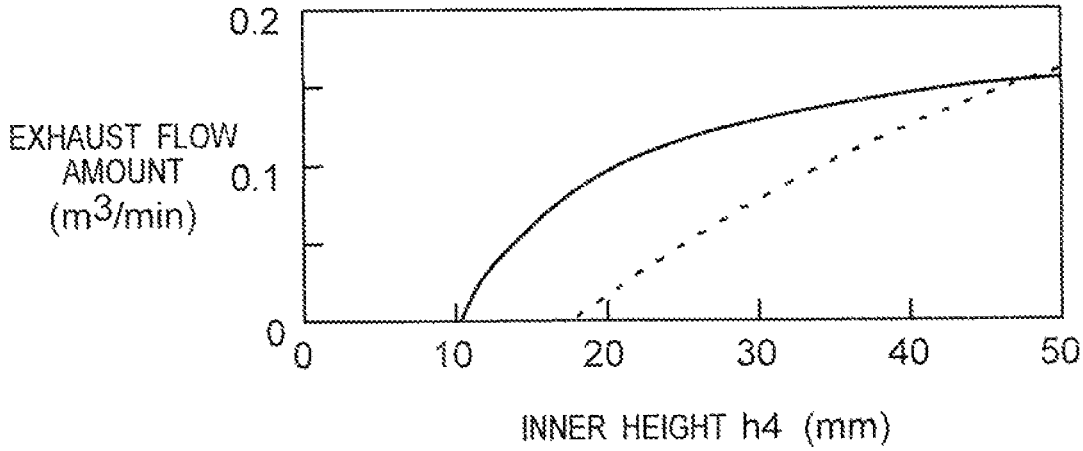
FIG. 7 is a graph showing the relationship between an inside height and an exhaust flow amount.

Next, the relationship between the inner height h4, which is the distance from the chassis 26 to the inner surface of the rear surface cover 30, and an exhaust flow amount will be explained using FIG. 7. FIG. 7 is a graph showing the relationship between the inner height h4 and the exhaust flow amount. In FIG. 7, the solid line shows the exhaust flow amount of the fan 1 according to the first embodiment of the present invention, and the dashed line shows the exhaust flow amount of the conventional fan 101. The measurement conditions are identical to those explained above.

In FIG. 7, when the fan 1 and the conventional fan 101 were compared at identical inner heights h4, the difference between the exhaust flow amounts of the fan 1 and the conventional fan 101 is large compared to FIG. 6. For example, when the inner height h4 of the fan 1 is 20 mm, an exhaust flow amount which is equivalent to that of the conventional fan 101 when the inner height h4 is 33 mm can be generated.

The reasons for the above are believed to be as follows. Basically, in the fan 1, since the motor-base 12 and the connecting strips 19*a* to 19*d* are disposed more toward the suction side than the motor-base 112 and the connecting strips 119*a* to 119*d* of the conventional fan 101, when the inner heights h4 of the fan 1 and the fan 101 are the same, the blades 5 are disposed more toward the exhaust side than the blades 105. In other words, compared to the conventional fan 101, the blades 5 can be brought closer to the inner surface of the rear surface cover 30 by just a total distance of the thickness of the connecting strips 19*a* to 19*d* and a gap between the connecting strips 19*a* to 19*d* and the blades 5. Thereby, compared to the conventional fan 101, in the fan 1, the suction distance h3 can be increased by approximately just the above-described total distance, and thus the exhaust flow amount can be increased.

Therefore, for example, when the exhaust flow amount necessary for cooling the electronic device is 0.1 $m^3$/min, in the conventional fan 101, the inner height h4 must be approximately 33 mm, whereas in the fan 1, the inner height h4 can be approximately 20 mm. In other words, the inner height h4 can be reduced by approximately 13 mm (=33 mm−20 mm). Therefore, according to the fan 1 of the first embodiment of the present invention, it is possible to make the electronic device much thinner.

Figure 28:
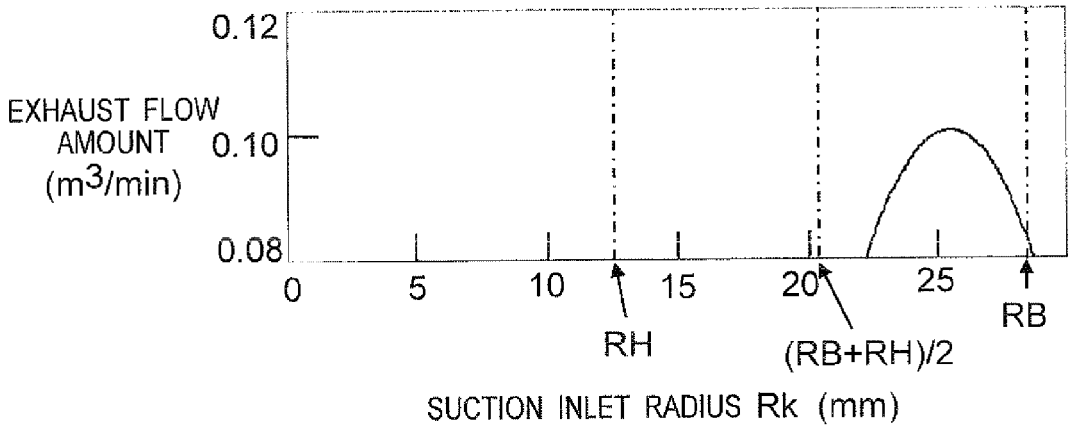
FIG. 28 is graph showing the relationship between a radius of the suction inlet and an exhaust flow amount of the fan of an electronic device in which the fan according to a first embodiment of the present invention is mounted.

Next, the results of tests to measure the exhaust flow amount when the radius of the suction inlet of the fan 1 according to the first embodiment of the preset invention is changed will be explained using FIG. 28. FIG. 28 is graph showing the relationship between the radius Rk of the suction inlet and the exhaust flow amount discharged from the exhaust holes 33 of the fan 1 shown in FIG. 2D, in the electronic device 24 shown in FIG. 4A in which the fan shown in FIG. 1A is mounted.

The above test was carried out in a state in which no other parts (for example, an electronic component, the circuit board 27, etc.) besides the fan 1 were disposed within the electronic device 24 as shown in FIGS. 4A to 4C. The exhaust flow amount was measured when the inner height h4 was 20 mm, and only the radius Rk of the suction inlet was changed.

From FIG. 28, it can be understood that the maximum value of the exhaust flow amount occurs in a range in which the radius Rk of the suction inlet 17 is smaller than the maximum radius RB of the rotation trajectory of the blades 5*x* and larger than an intermediate radius (RB+RH)/2 of the maximum radius RB of the rotation trajectory of the blades 5*x* and the radius RH of the hub 4.

Figure 29:
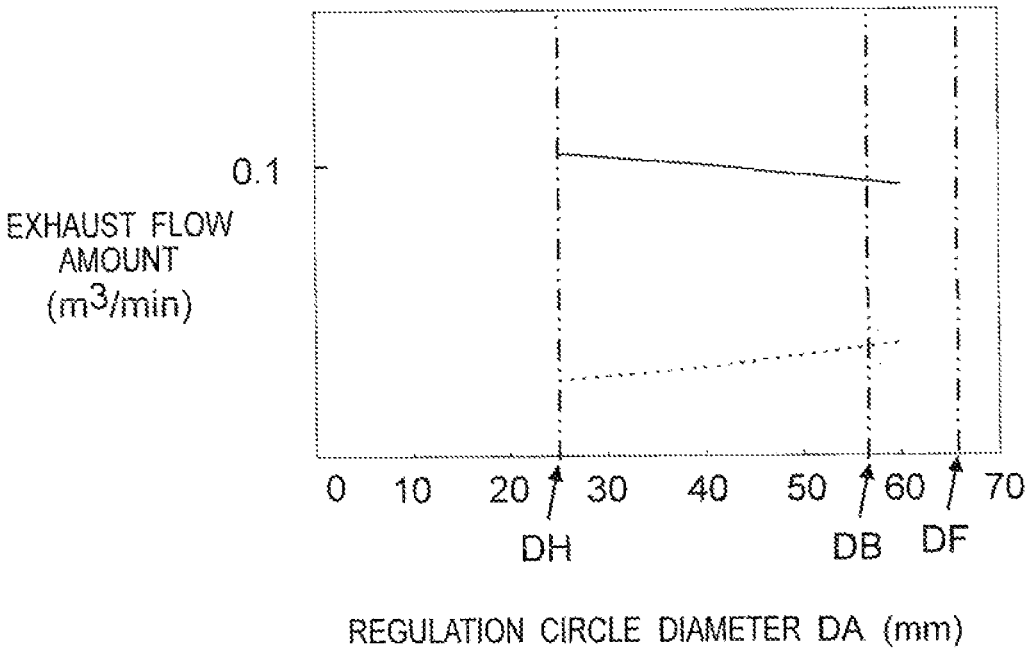
FIG. 29 is graph showing the relationship between a diameter of a regulation circle, which is a border on the inside of the region in which the exhaust holes are formed, and an exhaust flow amount in an electronic device in which the fan according to a first embodiment of the present invention is mounted.

Next, the results of tests to measure an exhaust flow amount in the electronic device 24 according to the first embodiment of the present invention when a diameter DA of the regulation circle 86, which is a border on the inside of the region in which the exhaust holes 33 are formed, is changed will be explained using FIG. 29. FIG. 29 is a graph showing the relationship between the diameter DA of the regulation circle 86 and the exhaust flow amount.

The above test was carried out in a state in which the fan 1 was disposed within the electronic device 24 as shown in FIGS. 4A to 4C, the radius Rk of the suction inlet of the fan 1 was 25 mm, and the inner height h4 of the electronic device 24 was 20 mm. In FIG. 29, the solid line shows the exhaust flow amount of the fan 1 in the state in which no parts other than the fan 1 are disposed within the electronic device 24, i.e. when the ventilation resistance of the casing of the electronic device is small. The dashed line in FIG. 29 shows the exhaust flow amount of the fan 1 in a state in which the electronic component and the circuit board 27 are compactly disposed within the electronic device 24 such that a gap through which air can flow barely remains, i.e. when the ventilation resistance of the casing of the electronic device is large. DH, DB, and DF within FIG. 29 show the outer diameter DH of the hub 4, the outer diameter DB of the rotation trajectory of the blades 5, and the minimum width DF in the vertical direction relative to the rotation axis 6 of the exhaust outlet 18 of FIG. 4B.

From FIG. 29, it can be understood that when the ventilation resistance of the casing of the electronic device is small, the exhaust flow amount decreases as the diameter DA of the regulation circle 86 increases, whereas when the ventilation resistance of the casing of the electronic device is large, the exhaust flow amount increases as the diameter DA of the regulation circle 86 increases. Further, when the ventilation resistance of the casing of the electronic device is large, it can be understood that setting the diameter DA of the regulation circle 86 to be a value near the outer diameter DB of the rotation trajectory of the blades 5 is effective in increasing the exhaust flow amount. Normally, the electronic component and the circuit board 27 are disposed within the casing of the electronic device such that the exhaust flow amount falls in between the solid line and the dashed line in FIG. 29.

As explained above, according to the fan 1 of the first embodiment of the present invention, the blades 5 are disposed, closer to the air flow guiding plate 81 than the air duct 82. Further, the inner diameter of the suction inlet 17 is formed to be smaller than the outer diameter of the rotation trajectory of the blades 5 and larger than an intermediate diameter of the outer diameter of the rotation trajectory of the blades 5 and the outer diameter of the hub 4. Thereby, as shown in FIG. 4B, regarding air which flows from the suction inlet 17 to the exhaust outlet 18, in addition to a component which flows in the rotation axis direction, a centrifugal component, which is a component which flows in a direction orthogonal to the rotation axis direction, can be largely generated. Therefore, according to the fan 1 of the first embodiment of the present invention, even if a distance between the suction inlet 17 and the parts, boards, and chassis or the like is small, the exhaust flow amount can be largely generated compared to the conventional fan 101.

According to the fan 1 of the first embodiment of the present invention, in a cross-section of the air duct 82 which is orthogonal to the rotation axis 6 and cuts across the outer periphery of the rotation trajectory of the blades 5, the air duct 82 has a first region which is near the outer edge 9 of the blades 5, and a second region which is separated from the outer edge 9 of the blades 5 compared to the first region, and spaces 95*a* to 95*d* are formed between the first region and the outer edge 9, and spaces 35*a* to 35*d* are formed between the second region and the outer edge 9. Thereby, as shown in FIG. 4C, since air can be passed through the spaces 35*a* to 35*d*, compared to the air flow created by the shape of the air duct 82 shown in FIG. 4B, the centrifugal component in a direction orthogonal to the rotation axis 6 can be further increased by just the amount that the exhaust resistance decreases. Therefore, according to the fan 1 according to the first embodiment of the present invention, the exhaust flow amount can be further increased.

According to the fan 1 of the first embodiment of the present invention, the motor-base 12 and the connecting strips 19*a* to 19*d* are disposed on the suction side, compared to the motor-base 112 and the connecting strips 119*a* to 119*d* of the conventional fan 101. Thereby, since the suction distance h3 can be increased, the exhaust flow amount can be increased.

Figure 8A:
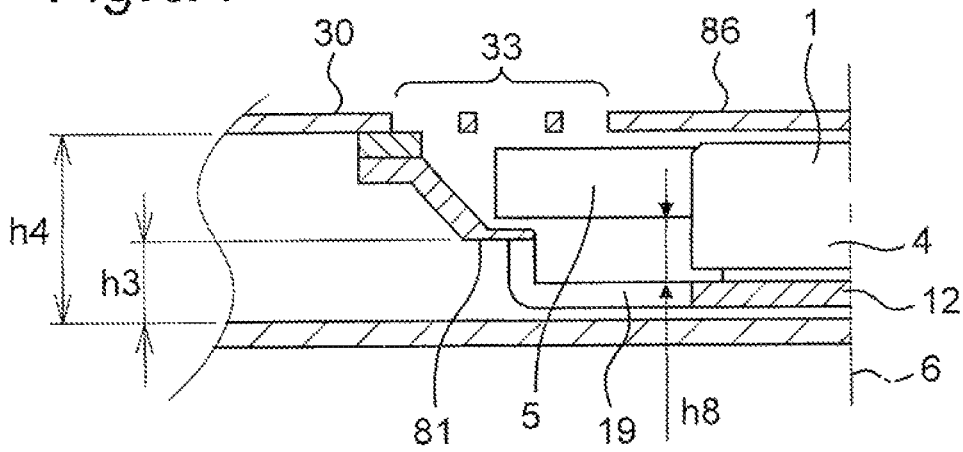
FIG. 8A is a partially enlarged cross-section view of an electronic device in which the fan according to a first embodiment of the present invention is mounted.
Figure 8B:
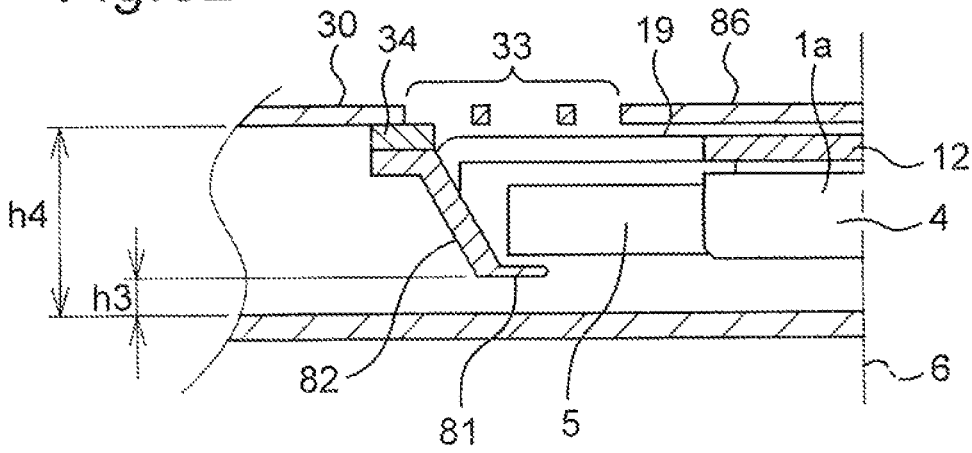
FIG. 8B is a partially enlarged cross-section view of an electronic device which is a comparative example of the electronic device shown in FIG. 8A.

The reason for this will be explained in detail below using FIG. 8. FIG. 8A is a partially enlarged cross-section view of the electronic device 24 in which the fan 1 according to the first embodiment of the present invention is mounted. In FIG. 8A, the motor-base 12 and the connecting strip 19 (19*a* to 19*d*) are disposed on a portion of the fan 1 on the suction side. FIG. 8B is a partially enlarged cross-section view of an electronic device which is a comparative example of the electronic device 24 shown in FIG. 8A. In FIG. 8B, the motor-base 12 and the connecting strip 19 are disposed on a portion of the fan 1*a* on the exhaust side. In FIGS. 8A and 8B, the inner height h4, and the thickness of the blade 5, the motor-base 12, and the connecting strip 19 are identical.

Comparing the suction distance h3 shown in FIG. 8A and the suction distance h3 shown in FIG. 8B, it can be seen that the suction distance h3 shown in FIG. 8B is smaller than the suction distance h3 shown in FIG. 8A. Specifically, the suction distance h3 shown in FIG. 8B is smaller than the suction distance h3 shown in FIG. 8A by just a total distance of the thickness of the connecting strip 19 and a gap between the connecting strip 19 and the blade 5. In other words, when the motor-base 12 and the connecting strip 19 are disposed on a portion of the fan 1*a* on the exhaust side, the suction distance h3 becomes smaller, and the exhaust flow amount decreases. On the other hand, as in the fan 1 according to the first embodiment of the present invention, when the motor-base 12 and the connecting strip 19 are disposed on apart on the suction side, the suction distance h3 can be increased, and thus the exhaust flow amount can be increased.

As shown in FIG. 8A, when the motor-base 12 and the connecting strip 19 are disposed on a portion of the fan 1 on the suction side, the air duct 82, the air flow guiding plate 81, the motor-base 12, and the connecting strip 19 can be integrally molded, and thus the manufacturing costs can be reduced. As shown in FIG. 8B, when the motor-base 12 and the connecting strip 19 are disposed on a portion of the fan 1*a* on the exhaust side, an undercut may be generated between the air duct 82 and the connecting strip 19.

According to the fan 1 of the first embodiment of the present invention, as shown in FIG. 2C, the connecting strip 19 is disposed to be spaced from the blade 5 by just the distance h2 from the air flow guiding plate 81. Thereby, as shown in FIG. 8A, a distance h8 between the connecting strip 19 and the blade 5 can be increased, and thus ventilation resistance and suction noise due to the connecting strip 19 approaching the blade 5 can be reduced. Therefore, the exhaust flow amount can be increased.

According to the fan 1 of the first embodiment of the present invention, as shown in FIG. 2C, the motor-base 12 is disposed to be spaced from the blade 5 by just the distance h2 from the air flow guiding plate 81. Thereby, the motor 10 disposed inside of the hub 4 can be formed to be longer by just the distance h2. Thus, since the sliding bearing built into the motor 10 can be lengthened, the life of the sliding bearing can be extended. Further, since the parts built into the motor 10 can be made larger, the torque of the motor can be increased. Thereby, in the case that dust gets clogged between the blades 5 and the air flow guiding plate 81 or the air duct 82, the force for removing the dust can be increased, and conditions in which the fan 1 cannot rotate can be suppressed.

According to the fan 1 of the first embodiment of the present invention, a plurality of blades 5 are attached to a side surface of the substantially cylindrical hub 4 having a 0.5° to 4° draft angle such that they do not overlap with each other when viewed from the rotation axis 6 to constitute the impeller 2. Thereby, the hub 4 and the blades 5 can be easily integrally molded (for example, by just drawing a die in one direction), and the impeller 2 can be made cheaply.

According to the fan 1 of the first embodiment of the present invention, as shown in FIG. 4A, the exhaust holes 33 on the rear surface cover 30 are disposed between a regulation circle 86 and a region facing the exhaust outlet 18 of the fan 1. The regulation circle 86 is formed centered on the rotation axis 6 and with a diameter which is larger than a diameter calculated by adding a length of ¼ of a value which is the difference between an inner diameter Dk of the suction inlet 17 and the outer diameter DH of the hub 4 to the outer diameter of the hub 4, and smaller than the outer diameter DB of the rotation trajectory of the blades 5. Thereby, the occurrence of the spiral flows 36 shown in FIG. 5B can be prevented, and in turn, a reduction of the exhaust flow amount can be prevented.

According to the fan 1 of the first embodiment of the present invention, when the ventilation resistance of the entire electronic device 24 is not that large, air having an axial flow component in the rotation axis direction can be sent. Therefore, compared to centrifugal-type blades which can only send air having a centrifugal component in a direction orthogonal to the rotation axis direction, the air flow when the noise level of the fan is the same can be increased.

In the first embodiment of the present invention, the shape of the hub 4 is substantially cylindrical, but the shape of the hub 4 can also be a rotationally-balanced polygonal column.

In the first embodiment of the present invention, as shown in FIG. 1, the air duct 82 is constituted such that its distance from the rotation axis 6 gradually expands from the suction side toward the exhaust side. However, the present invention is not limited to this constitution. For example, as shown in FIGS. 9E and 9F, instead of the air duct 82, an air duct can be constituted with a curved surface 85 and a wall surface 87 which is substantially orthogonal to the rotation axis 6.

Figure 9A:
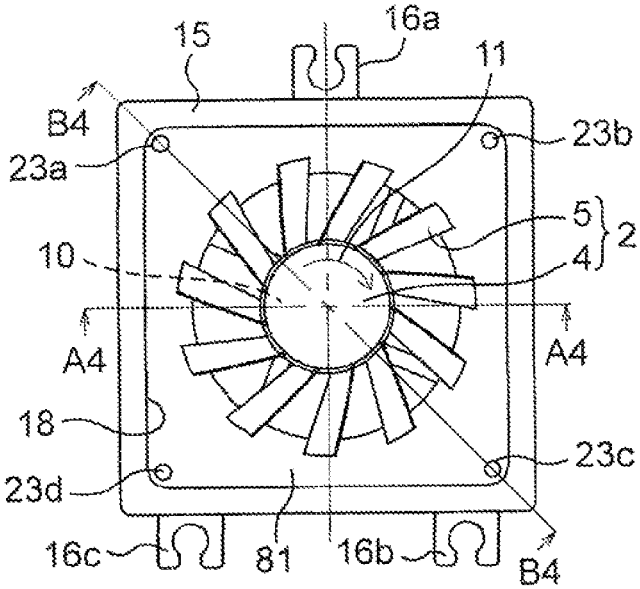
FIG. 9A is a plan view of the fan according to a first embodiment of the present invention when viewed from the exhaust side.
Figure 9B:
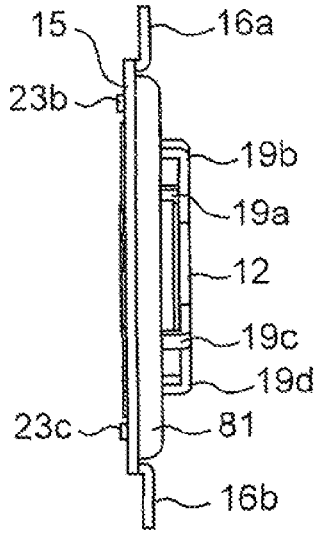
FIG. 9B is a right-side surface view of the fan shown in FIG. 9A.
Figure 9C:
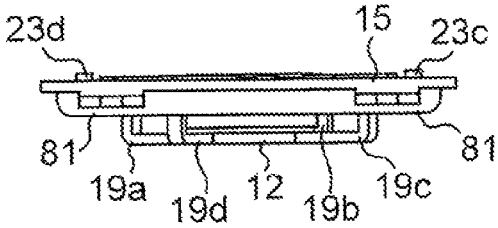
FIG. 9C is a bottom-side surface view of the fan shown in FIG. 9A.
Figure 9D:
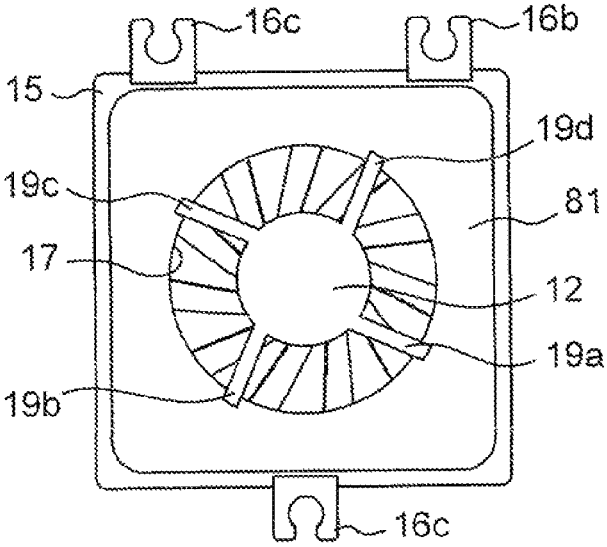
FIG. 9D is a plan view of the fan shown in FIG. 9A when viewed from the suction side.
Figure 9E:
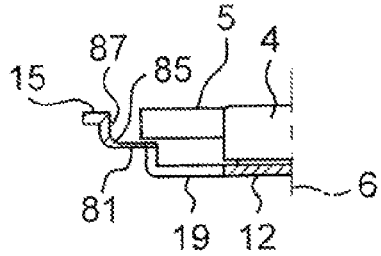
FIG. 9E is a partial cross-section view taken along line A4-A4 of the fan shown in FIG. 9A.
Figure 9F:
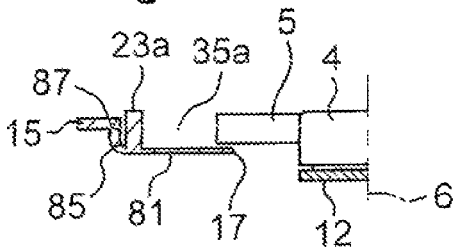
FIG. 9F is a partial cross-section view taken along line B4-B4 of the fan shown in FIG. 9A.

FIG. 9A is a plan view of a fan in which the air duct is constituted with the curved surface 85 and the wall surface 87 when viewed from the exhaust side. FIG. 9B is a right-side view of the fan shown in FIG. 9A, FIG. 9C is a bottom-side surface view of the fan shown in FIG. 9A, and FIG. 9D is a plan view of the fan shown in FIG. 9A when viewed from the suction side. FIG. 9E is a partial cross-section view taken along line A4-A4 of the fan shown in FIG. 9A, and FIG. 9F is a partial cross-section view taken along line B4-B4 of the fan shown in FIG. 9A.

Figure 10:
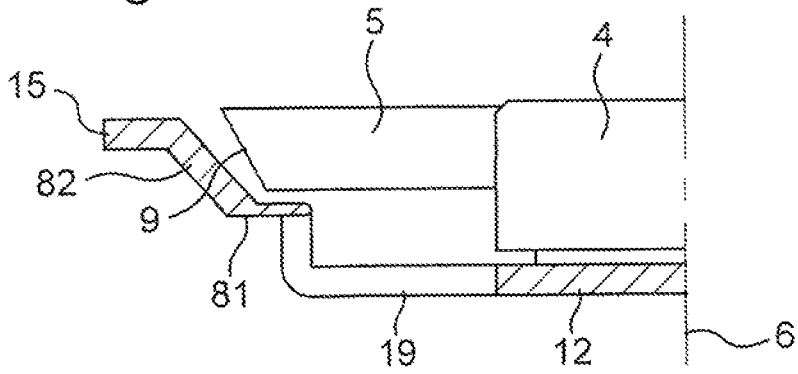
FIG. 10 is a view showing an alternate embodiment of the blades of the fan according to a first embodiment of the present invention.

In the first embodiment of the present invention, as shown in FIG. 2D, the outer edge 9 of the blades 5 is formed to be substantially parallel to the rotation axis 6, but the present invention is not limited to this constitution. For example, as shown in FIG. 10, the outer edge 9 of the blades 5 can also be formed so that its distance from the rotation axis 6 expands from the suction side toward the exhaust side. In this case, the exhaust flow amount can be increased compared to the case in which the outer edge 9 of the blades 5 is substantially parallel to the rotation axis 6.

Figure 11:
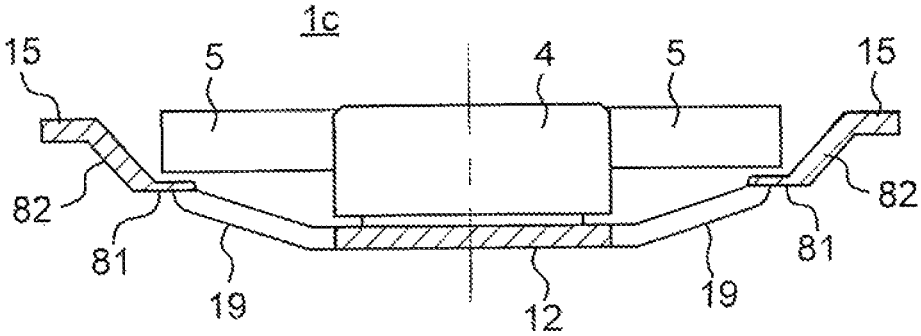
FIG. 11 is a view showing an alternate embodiment of the connecting strips of the fan according to a first embodiment of the present invention.
Figure 12:
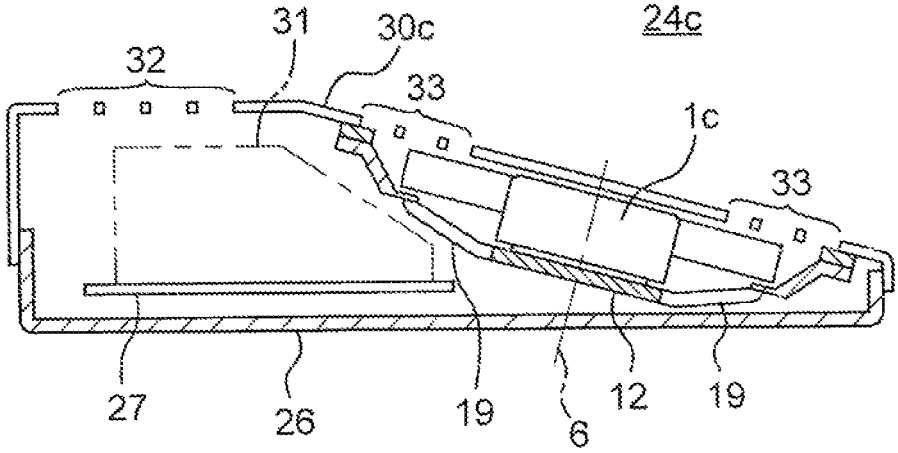
FIG. 12 is a view showing a partial cross-section of an electronic device in which the fan shown in FIG. 11 is mounted.

In the first embodiment of the present invention, the connecting strips 19 are disposed orthogonal to the rotation axis 6, but the present invention is not limited to this constitution. For example, as shown in FIG. 11, the connecting strips 19 can be disposed at an incline relative to a direction orthogonal to the rotation axis 6 so that the air flow guiding plate 81 and the motor-base 12 are connected at an angle. The fan 1*c* in which the connecting strips 19 are disposed in this way is particularly useful when it is mounted in an electronic device 24*c* having a rear surface cover 30*c* as shown in FIG. 12. In other words, since the connecting strips 19 are at an angle, if the fan 1*c* is attached at an incline relative to the chassis 26, the fan 1*c* can be disposed close to the chassis 26 or the electronic component in the mounting region 31, and this is effective for the miniaturization of the electronic device.

Second Embodiment

Figure 13A:
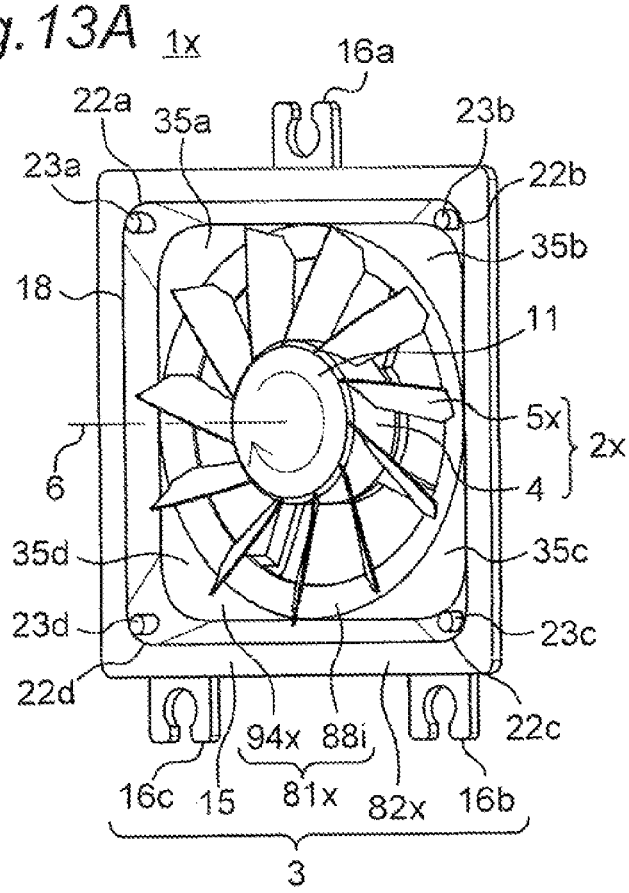
FIG. 13A is a perspective view of the fan according to a second embodiment of the present invention when viewed from the exhaust side.
Figure 13B:
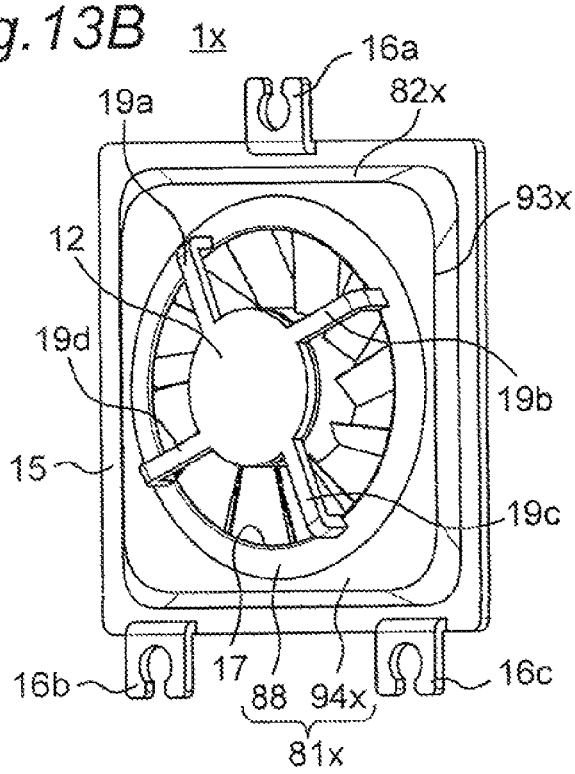
FIG. 13B is a perspective view of the fan shown in FIG. 13A when viewed from the suction side.
Figure 14A:
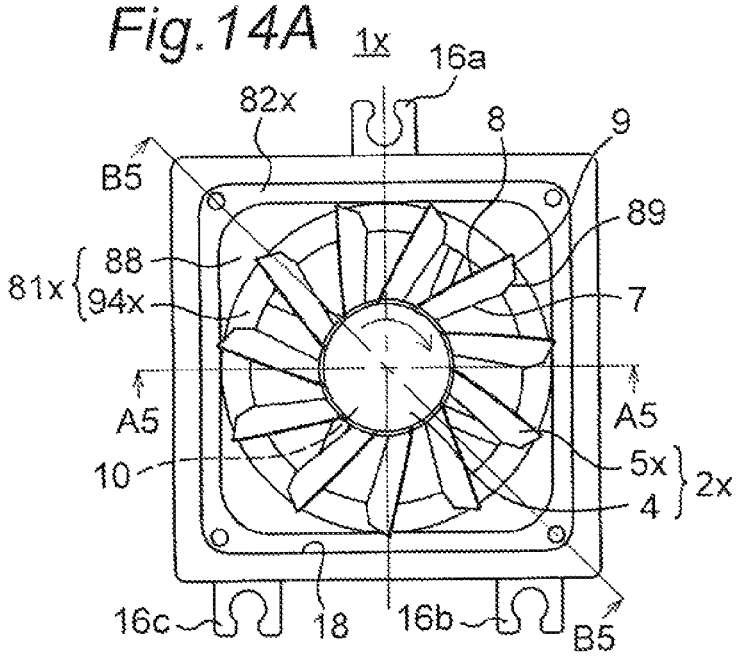
FIG. 14A is a plan view of the fan according to a second embodiment of the present invention when viewed from the exhaust side.
Figure 14B:
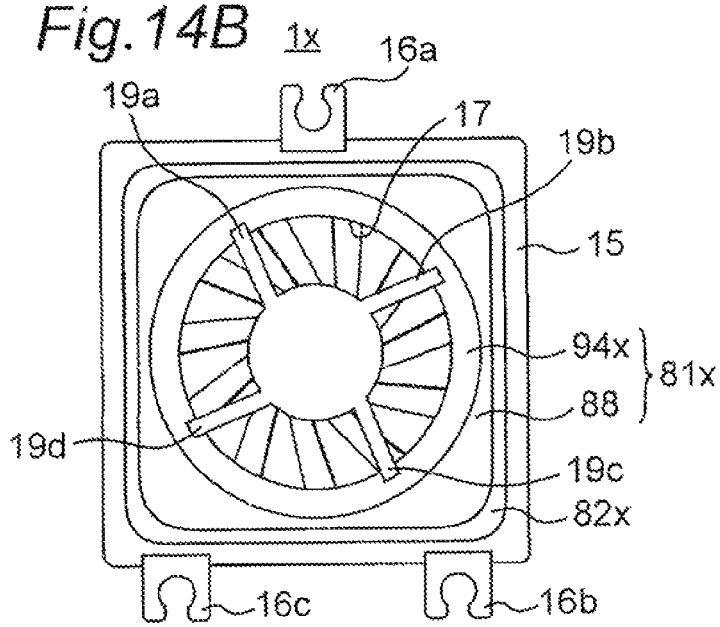
FIG. 14B is a plan view of the fan shown in FIG. 14A when viewed from the suction side.
Figure 14C:
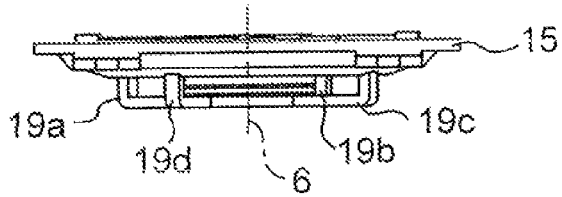
FIG. 14C is a bottom-side surface view of the fan shown in FIG. 14A.
Figure 14D:
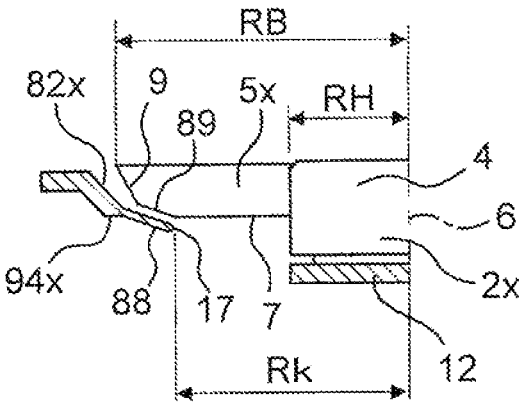
FIG. 14D is a partial cross-section view taken along line A5-A5 of the fan shown in FIG. 14A.
Figure 14E:
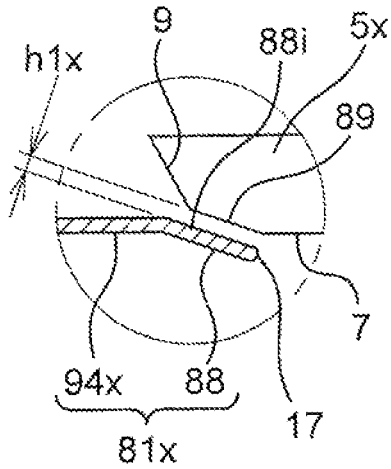
FIG. 14E is a partial cross-section view taken along line B5-B5 of the fan shown in FIG. 14A.
Figure 14F:
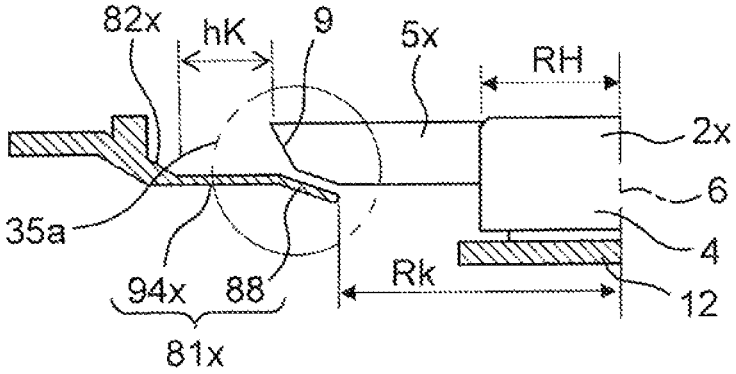
FIG. 14F is a partially enlarged cross-section view of FIG. 14E.

Next, the constitution of the fan according to a second embodiment of the present invention will be explained using FIGS. 13A to 16B. FIG. 13A is a perspective view of the fan according to the second embodiment of the present invention when viewed from the exhaust side, and FIG. 13B is a perspective view of the fan shown in FIG. 13 A when viewed from the suction side. FIG. 14A is a plan view of the fan according to the second embodiment of the present invention when viewed from the exhaust side, and FIG. 14B is a plan view of the fan shown in FIG. 14A when viewed from the suction side. FIG. 14C is a bottom-side surface view of the fan shown in FIG. 14A. FIG. 14D is a partial cross-section view taken along line A5-A5 of the fan shown in FIG. 14A, and FIG. 14E is a partial cross-section view taken along line B5-B5 of the fan shown in FIG. 14A. FIG. 14F is a partially enlarged cross-section view of FIG. 14E. The outline of the blade 5 shown in FIGS. 14D and 14E shows the rotation trajectory when the blade 5 is rotating.

The constitution of the fan according to the second embodiment of the present invention will be explained below.

A fan 1*x*, which is the fan according to the second embodiment of the present invention, is different from the fan 1 of the first embodiment in that the length of the air duct 82 on the suction side is shortened, and accordingly the shapes of the air flow guiding plate 81 and the blades 5 are modified. The fans are the same with respect to all other points, and the explanation below omits any duplicate explanations.

An air flow guiding plate 81$x$ includes an annular inclined inner edge portion 88 and an annular flat plate 94$x$ surrounding the periphery of the inclined inner edge portion 88. The periphery of the flat plate 94$x$ is connected to a suction-side peripheral edge portion 93$x$ of an annular air duct 82$x$.

The inner periphery on the rotation axis 6 side of the inclined inner edge portion 88 forms a suction inlet 17, and has a side surface shape of a circular truncated cone centered on the rotation axis 6. The inclined inner edge portion 88 is formed such that its distance from the rotation axis 6 expands from the suction side toward the exhaust side. The flat plate 94$x$ is disposed substantially parallel to a flat surface which is orthogonal to the rotation axis 6. An exhaust outlet 18 is formed on the end of the air duct 82$x$ on the exhaust side. The suction inlet 17 and the exhaust outlet 18 are formed to be substantially parallel relative to the flat surface which is orthogonal to the rotation axis 6. The suction inlet 17 and the exhaust outlet 18 are in a so-called front-rear relationship.

A motor-base 12 is disposed on a portion of the fan 1$x$ on the suction side. The motor-base 12 is connected and fixed to the inclined inner edge portion 88 by four connecting strips 19$a$ to 19$d$. As shown in FIG. 14A, blades 5$x$ of an impeller 2$x$ include a front edge 7, a back edge 8, and an outer edge 9 which forms the outer periphery of the rotation trajectory. A chamfered portion 89 having a liner cross-section is provided between the front edge 7 and the outer edge 9.

As shown in FIGS. 14D and 14E, the outer edge 9 of the blade 5$x$ is formed such that its distance from the rotation axis 6 expands from the suction side toward the exhaust side.

As shown in FIGS. 14D and 14F, a gap between the air flow guiding plate 81$x$ and the blade 5$x$ is formed smaller than a gap between the blade 5$x$ and the air duct 82$x$. The gap between the air flow guiding plate 81$x$ and the blade 5$x$ is formed to reach a minimum between the chamfered portion 89 of the blade 5$x$ and an inner surface 88$i$ of the inclined inner edge portion 88. Thereby, reverse flow of air from the exhaust outlet 18 to the suction inlet 17 can be prevented.

The gap between the chamfered portion 89 and the inner surface 88$i$ of the inclined inner edge portion 88 will be defined below as a gap h1$x$. Considering the run out of the impeller 2$x$, the parts assembly tolerance, deformations due to thermal expansion, locking of the rotation of the impeller 2$x$ due to adherence of dust in the air, mass production margin, and the like, the gap h1$x$ is preferably set to be the minimum value at which the inner surface 88$i$ and the impeller 2$x$ do not contact each other.

A radius Rk of the suction inlet 17 is set to be smaller than a maximum radius RB of the rotation trajectory of the blades 5$x$ and larger than an intermediate radius (RB+RH)/2 of the maximum radius RB of the rotation trajectory of the blades 5$x$ and the radius RH of the hub 4.

The air duct 82$x$ is formed such that its distance from the rotation axis 6 expands in a direction orthogonal to the rotation axis 6 from the suction inlet 17 toward the exhaust outlet 18.

The exhaust outlet 18 is formed in a substantially square shape having fillets 22$a$ to 22$d$ in its four corners. As shown in FIGS. 13A and 14E, spaces 35$a$ to 35$d$ are formed near the fillets 22$a$ to 22$d$. The spaces 35$a$ to 35$d$ are positioned between an inner surface of the air duct 82$x$ and the outer edge 9 of the blades 5$x$. A distance hK between a contact point of the air duct 82$x$ and the air flow guiding plate 81$x$ in a direction orthogonal to the rotation axis 6 and an outer edge of the blades 5$x$ is set to be ⅓ or more of a distance which is the difference between the radius Rk of the suction inlet 17 and the radius RH of the hub 4 in a direction orthogonal to the rotation axis 6. In other words, the width of the spaces 35$a$ to 35$d$ in a direction orthogonal to the rotation axis 6 is ⅓ or more of the distance which is the difference between the radius Rk of the suction inlet 17 and the radius RH of the hub. Thereby, air which is sucked into the fan 1$x$ from the suction inlet 17 can be efficiently discharged to the outside of the fan 1$x$ from the exhaust outlet 18.

According to the fan 1$x$ of the second embodiment of the present invention, the blades 5$x$ are disposed closer to the air flow guiding plate 81$x$ than the air duct 82$x$. A gap between the air flow guiding plate 81$x$ and the blades 5$x$ is formed to reach a minimum at the gap h1$x$ between the chamfered portion 89 of the blades 5$x$ and the inner surface 88$i$ of the inclined inner edge portion 88. Further, the radius Rk of the suction inlet 17 is set to be smaller than the maximum radius RB of the rotation trajectory of the blades 5$x$ and larger than an intermediate radius of the maximum radius RB of the impeller 2$x$ and the radius RH of the hub 4. Thereby, since air flowing from the suction inlet 17 to the exhaust outlet 18 can be passed through a gap between the blades 5$x$ and the air duct 82$x$, in addition to a component in the rotation axis direction, a centrifugal component, which is a component in a direction orthogonal to the rotation axis 6, can be largely generated. Therefore, according to the fan 1$x$ of the second embodiment of the present invention, even if a distance between the suction inlet 17 and the parts, boards, and chassis or the like is small, the exhaust flow amount can be largely generated compared to the conventional fan 101.

In addition, according to the fan 1$x$ of the second embodiment of the present invention, the spaces 35$a$ to 35$d$, which have a width of ⅓ or more of the distance which is the difference between the radius Rk of the suction inlet 17 and the radius RH of the hub 4, are provided at the four corners of the exhaust outlet 18. Thereby, since air can be passed through the spaces 35$a$ to 35$d$, the exhaust resistance can be reduced, and the centrifugal component in a direction orthogonal to the rotation axis 6 can be further increased. Therefore, according to the fan 1$x$ of the second embodiment of the present invention, the exhaust flow amount can be further increased.

Figure 15:
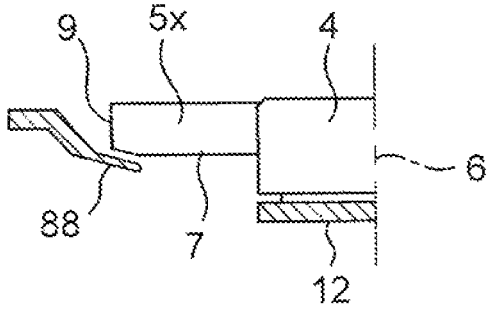
FIG. 15 is a view showing an alternate embodiment of the blades of the fan according to a second embodiment of the present invention.

In the second embodiment of the present invention, as shown in FIG. 14F, the outer edge 9 of the blade 5$x$ is formed so that its distance from the rotation axis 6 expands from the suction side toward the exhaust side, but the present invention is not limited to this embodiment. For example, as shown in FIG. 15, the exhaust side portion of the outer edge 9 can also be formed substantially parallel to the rotation axis 6.

Figure 16A:
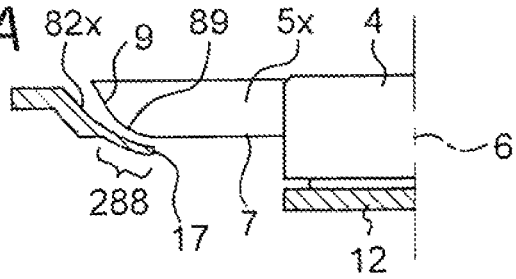
FIG. 16A is a view showing an alternate embodiment of the fan shown in FIG. 14D.
Figure 16B:
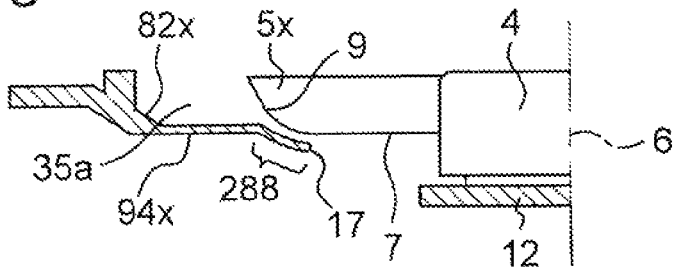
FIG. 16B is a view showing an alternate embodiment of the fan shown in FIG. 14E.

Further, in the second embodiment of the present invention, as shown in FIGS. 14D to 14E, a chamfered portion 89 having a liner cross-section is provided to the blades 5$x$, but the chamfered portion 89 can also be formed to have a curved cross-section as shown in FIGS. 16A and 16B. The outer edge 9 of the blades 5$x$ may also be formed to have a curved cross-section. In this case, instead of an inclined inner surface 88 having a linear cross-section, the air flow guiding plate 81$x$ can have an inclined inner edge portion 288 having a curved cross-section corresponding to the outer edge 9 having a curved cross-section, as shown in FIGS. 16A and 16B.

Third Embodiment

Next, the constitution of the fan according to a third embodiment of the present invention will be explained using FIG. 17.

Figure 17A:
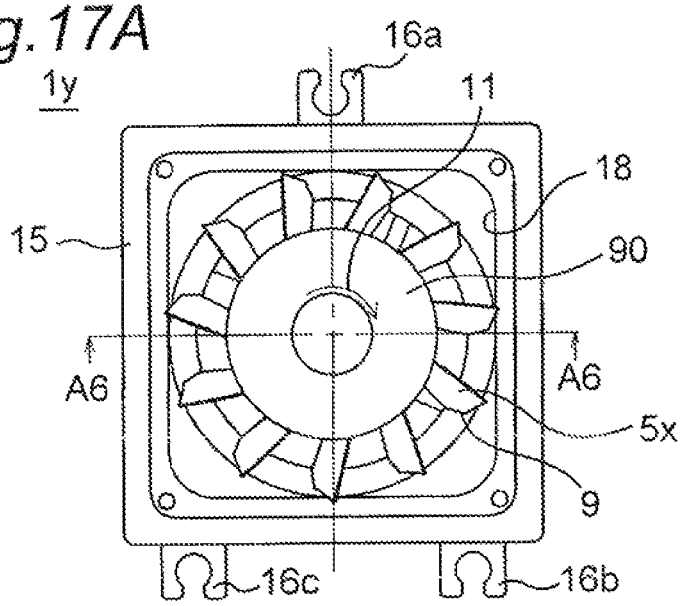
FIG. 17A is a plan view of the fan according to a third embodiment of the present invention when viewed from the exhaust side.
Figure 17B:
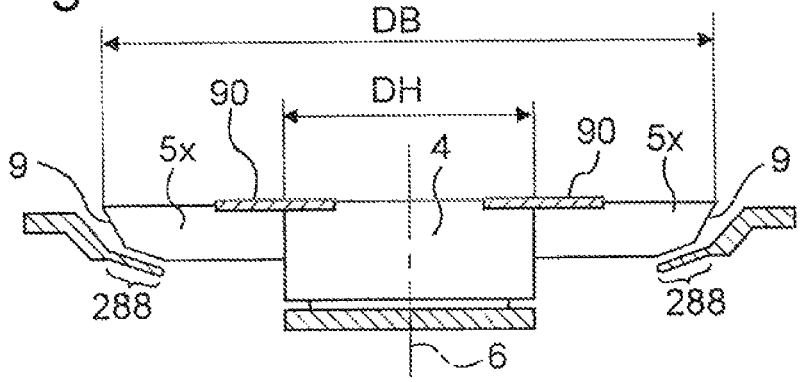
FIG. 17B is a partial cross-section view taken along line A6-A6 of the fan shown in FIG. 17A.
Figure 18:
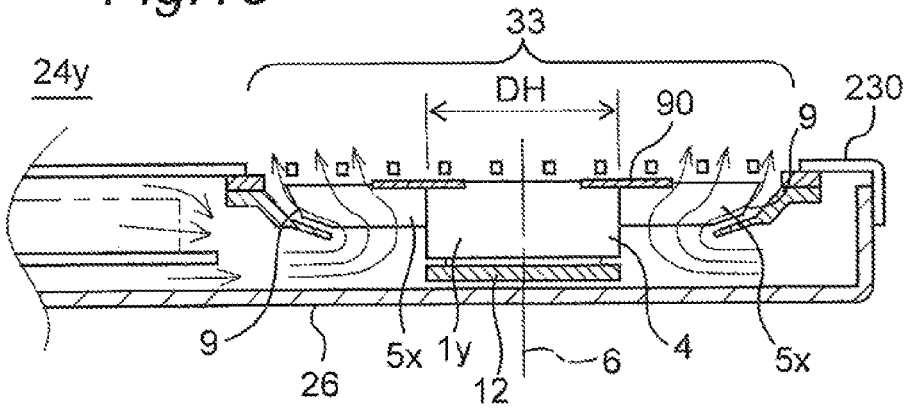
FIG. 18 is a partial cross-section view of an electronic device in which the fan shown in FIG. 17A is mounted.

FIG. 17A is a plan view of a fan 1$y$ according to a third embodiment of the present invention when viewed from the exhaust side. FIG. 17B is a partial cross-section view taken along line A6-A6 of the fan 1$y$ shown in FIG. 17A. The outline of the blade 5*x* shown in FIG. 17B shows the rotation trajectory when the blade 5*x* is rotating. FIG. 18 is a partial cross-section view of an electronic device in which the fan 1*y* shown in FIG. 17A is mounted.

A fan 1*y* according to the third embodiment of the present invention differs from the fan 1*x* according to the second embodiment in that a disc 90 is newly provided. The fans are the same with respect to all other points, and the constitution of the fan 1*y* according to the third embodiment will be explained below while omitting any duplicate explanations.

The disc 90 is fixed to a portion of the blade 5*x* or the hub 4 on the exhaust side centered on the rotation axis 6. The radius of the disc 90 is set to be larger than the outer diameter DH of the hub 4 and smaller than the outermost diameter DB of the outer edge 9 of the blade 5*x*. In FIGS. 17A to 18, the disc 90 is shown as an annular plate member. Here, a disc also includes an annular plate member.

Next, a constitution in which the fan 1*y* is mounted in the electronic device 24 will be explained.

In FIG. 18, an electronic device 24*y* equipped with the fan 1*y* has the same constitution as that of the electronic device shown in FIG. 5A other than the fan. FIG. 18 shows a cross-section corresponding to the cross-section taken along line A3-A3 in FIG. 5A.

Similar to the constitution explained above using FIG. 5A, a plurality of circular exhaust holes 33 are uniformly provided to the inside of a rear surface cover 230 in a region facing the exhaust outlet 18 of the fan 1*y*.

With the above configuration, even if the exhaust holes 33 of the rear surface cover 230 are provided in a region corresponding to the inside of the outer diameter DH of the hub 4, the occurrence of the spiral flows 36 explained above using FIG. 5B can be prevented by the disc 90. Thereby, reductions in the exhaust flow amount can be prevented.

The radius of the disc 90 is adjusted to an optimal value in accordance with the ventilation resistance within the casing of the electronic device, i.e. if the radius is set to be large when the ventilation resistance is large, and the radius is set to be small when the ventilation resistance is small, then the exhaust flow amount can be increased in turn.

According to the third embodiment of the present invention, since the disc 90 is fixed to a portion of the blades 5*x* or the hub 4 on the exhaust side, a gap between the fan 1*y* and the rear surface cover 230 becomes larger, and thus even if the fan 1*y* is disposed, air can be prevented from circling around from the gap to the vicinity of the side walls of the hub 4. Thereby, reductions in the exhaust flow amount can further be prevented.

Fourth Embodiment

Next, the constitution of the fan according to a fourth embodiment of the present invention will be explained using FIGS. 19 to 23.

Figure 19A:
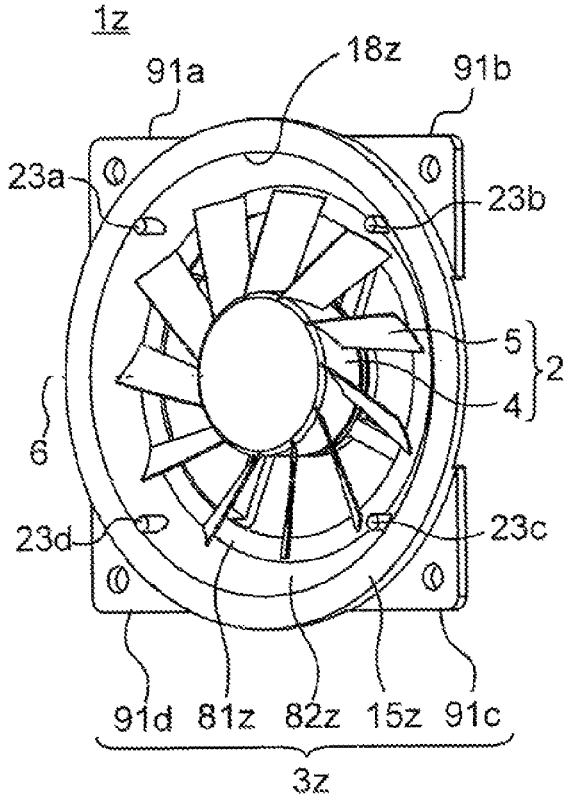
FIG. 19A is a perspective view of the fan according to a fourth embodiment of the present invention when viewed from the exhaust side.
Figure 19B:
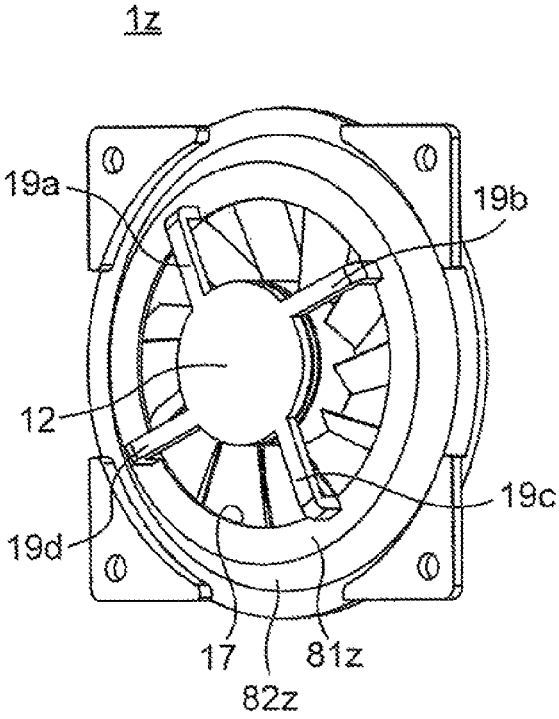
FIG. 19B is a perspective view of the fan shown in FIG. 19A when viewed from the suction side.
Figure 20A:
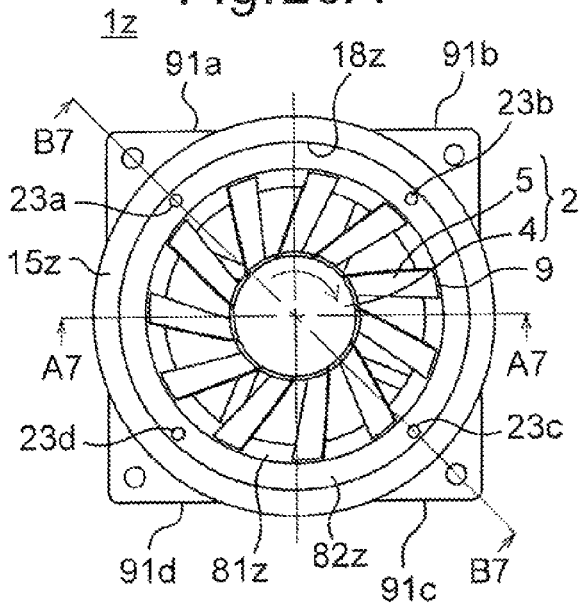
FIG. 20A is a plan view of the fan according to a fourth embodiment of the present invention when viewed from the exhaust side.
Figure 20B:
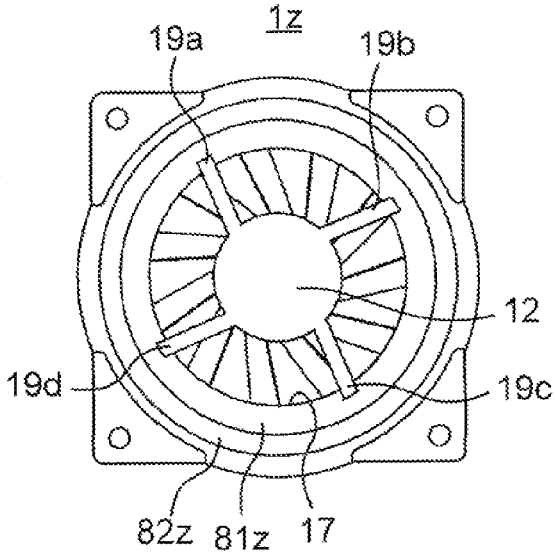
FIG. 20B is a plan view of the fan shown in FIG. 20A when viewed from the suction side.
Figure 20C:
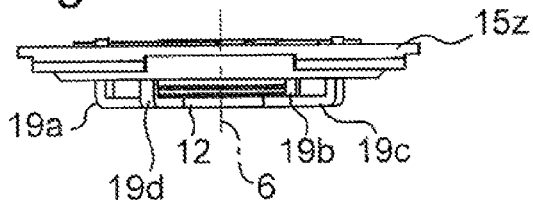
FIG. 20C is a bottom-side surface view of the fan shown in FIG. 20A.
Figure 20D:
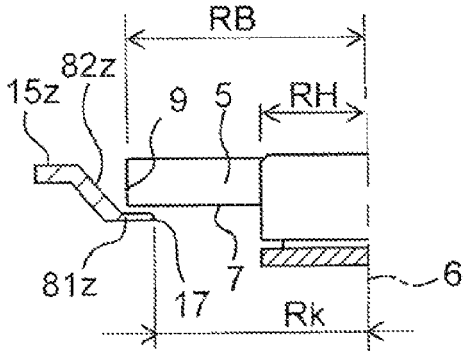
FIG. 20D is a partial cross-section view taken along line A7-A7 of the fan shown in FIG. 20A.
Figure 20E:
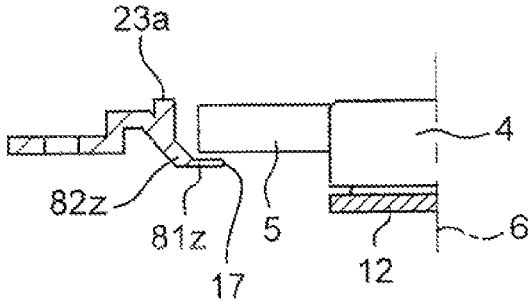
FIG. 20E is a partial cross-section view taken along line B7-B7 of the fan shown in FIG. 20A.

FIG. 19A is a perspective view of the fan according to the fourth embodiment of the present invention when viewed from the exhaust side, and FIG. 19B is a perspective view of the fan shown in FIG. 19A when viewed from the suction side. FIG. 20A is a plan view of the fan according to the fourth embodiment of the present invention when viewed from the exhaust side, and FIG. 20B is a plan view of the fan shown in FIG. 20A when viewed from the suction side. FIG. 20C is a bottom-side surface view of the fan shown in FIG. 20A. FIG. 20D is a partial cross-section view taken along line A7-A7 of the fan shown in FIG. 20A, and FIG. 20E is a partial cross-section view taken along line B7-B7 of the fan shown in FIG. 20A. The outline of the blade 5 shown in FIGS. 20D and 20E shows the rotation trajectory when the blade 5 is rotating.

A fan 1*z* according to the fourth embodiment of the present invention differs from the fan 1 of the first embodiment in that it has a casing 3*z* which has a different shape than that of the casing 3. The fans are the same with respect to all other points, and the constitution of the fan 1*z* according to the fourth embodiment will be explained below while omitting any duplicate explanations.

The casing 3*z* includes an air flow guiding plate 81*z*, an air duct 82*z*, a flange portion 15*z*, and fixing arms 91*a* to 91*d*. Holes for screw fittings are opened on the fixing arms 91*a* to 91*d*.

The air duct 82*z* and the air flow guiding plate 81*z* are formed in a shape made by rotating a cross-section shape shown in FIG. 20D 360 degrees centered on the rotation axis 6. In other words, the air duct 82*z* and the air flow guiding plate 81*z* are different from the air duct 82 and the air flow guiding plate 81 of the fan 1 shown in FIG. 2A in that they do not have spaces 35*a* to 35*d*.

The flat plate-shaped air flow guiding plate 81*z* is formed on a suction-side peripheral edge portion of the air duct 82*z* to block an opening on the suction-side end of the air duct 82*z*. The air flow guiding plate 81*z* is disposed parallel to a flat surface which is orthogonal to the rotation axis 6. The suction inlet 17 is formed on the center of the air flow guiding plate 81*z*. The center of the suction inlet 17 is positioned on the rotation axis 6.

An exhaust outlet 18*z* is formed on the end of the air duct 82*z* on the exhaust side. The flange portion 15*z* is formed parallel to a flat surface which is orthogonal to the rotation axis 6 on the outer periphery of the exhaust outlet 18*z*. The fixing arms 91*a* to 91*d* are formed on the outer periphery of the flange portion 15*z* for fixing other members to the fan 1*z*. The suction inlet 17 and the exhaust outlet 18*z* are formed to be parallel to a flat surface which is orthogonal to the rotation axis 6. The suction inlet 17 and the exhaust outlet 18*z* are in a so-called front-rear relationship.

The motor-base 12 is disposed on a portion of the fan 1*z* on the suction side. The motor-base 12 is connected and fixed to the air flow guiding plate 81*z* by four connecting strips 19*a* to 19*d*. As shown in FIG. 20D, the suction inlet 17 is formed to be facing the front edge 7 of the blades 5.

If the radius Rk of the suction inlet 17 is too small, the opening area of the suction inlet 17 becomes too small and thus the air flow decreases. On the other hand, if the radius Rk of the suction inlet 17 is too large, when an obstruction is placed near the suction inlet, the exhaust flow amount decreases because the centrifugal component of the air within the fan 1*z* cannot be generated in a large amount. Therefore, the radius Rk of the suction inlet 17 has a point within the range in which it is not too small and not too large at which the maximum air flow is generated. Specifically, the optimal value of the radius Rk of the suction inlet 17 is considered to be within a range in which it is smaller than the maximum radius RB of the rotation trajectory of the blades 5 and larger than an intermediate radius (RB+RH)/2 of the maximum radius RB of the rotation trajectory of the blades 5 and the radius RH of the hub 4. Therefore, the radius Rk of the suction inlet 17 is set to be smaller than the maximum radius RB of the rotation trajectory of the blades 5 and larger than an intermediate radius (RB+RH)/2 of the maximum radius RB of the rotation trajectory of the blades 5 and the radius RH of the hub 4.

The air duct 82z is disposed to be inclined toward the front edge 7 of the blades 5 so that a gap between an inner surface of the air duct 82z and the blades 5 reaches a minimum near the suction inlet 17.

The blades 5 are closer to the air flow guiding plate 81z than the air duct 82z. In other words, a gap near the suction inlet 17 between the front edge 7 of the blades 5 and the air flow guiding plate 81z is formed to be smaller than a gap between the outer edge 9 of the blades 5 and the inner surface of the air duct 82z. Thereby, reverse flow of air from the exhaust outlet 18 to the suction inlet 17 can be prevented.

Considering the run out of the impeller 2, the parts assembly tolerance, deformations due to thermal expansion, locking of the rotation of the impeller due to adherence of dust in the air, mass production margin, and the like, a gap between the blades 5 and the air flow guiding plate 81z is preferably set to be the minimum value at which the air flow guiding plate 81z and the front edge 7 of the blades 5 do not contact each other.

The air duct 82z is formed such that its distance from the rotation axis 6 gradually expands from the suction inlet 17 toward the exhaust outlet 18.

According to the fan 1z of to the fourth embodiment of the present invention, the blades 5 are disposed closer to the air flow guiding plate 81z than the air duct 82z. Further, the inner diameter of the suction inlet 17 is set to be smaller than the outer diameter of the rotation trajectory of the blades 5 and larger than an intermediate diameter of the outer diameter of the rotation trajectory of the blades 5 and the outer diameter of the hub 4. Thereby, since air flowing from the suction inlet 17 to the exhaust outlet 18 can be passed through a gap between the blades 5 and the air duct 82z, in addition to a component in the direction of the rotation axis 6, a centrifugal component, which is a component in a radial direction relative to the rotation axis 6, can be largely generated. Therefore, according to the fan 1z of the fourth embodiment of the present invention, even if the distance between the suction inlet 17 and the parts, boards, and chassis or the like is small, the exhaust flow amount can be largely generated compared to the conventional fan 101.

Figure 21:
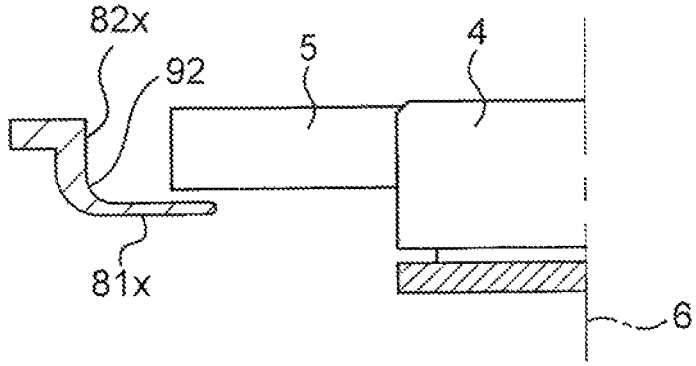
FIG. 21 is a view showing an alternate embodiment of the fan according to a fourth embodiment of the present invention.
Figure 22:
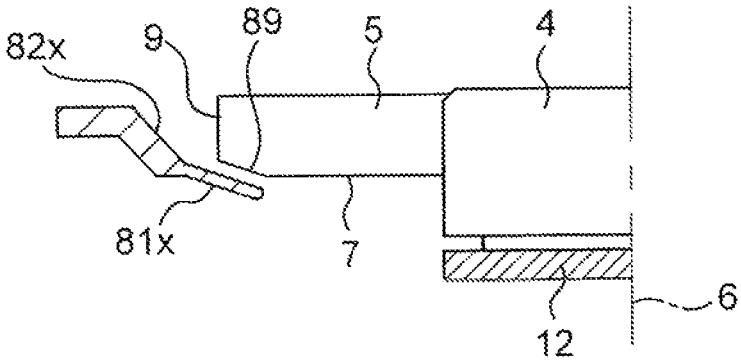
FIG. 22 is a view showing an alternate embodiment which is separate from that of FIG. 21 of the fan according to a fourth embodiment of the present invention.
Figure 23:
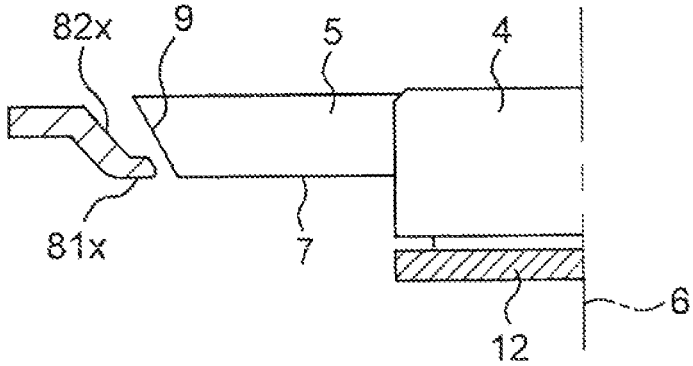
FIG. 23 is a view showing an alternate embodiment which is separate from those of FIGS. 21 and 22 of the fan according to a fourth embodiment of the present invention.
Figure 24A:
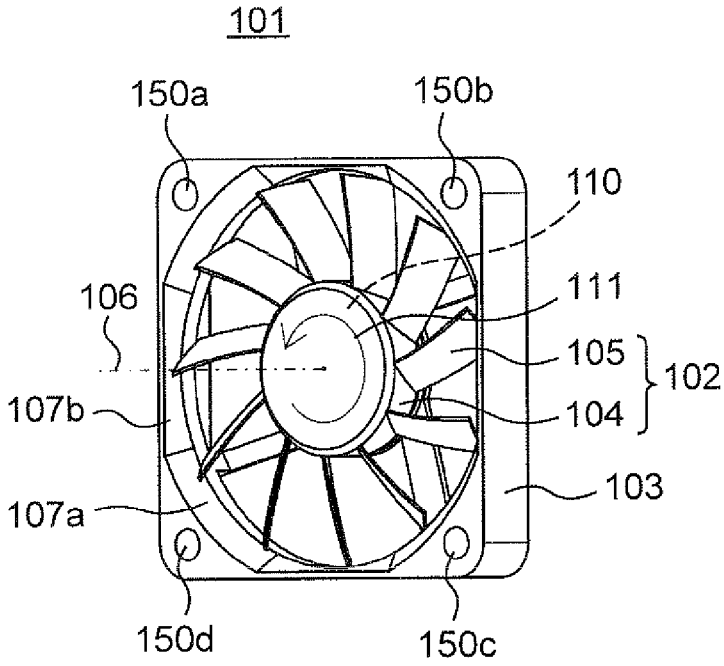
PRIOR ART Fig.24A
FIG. 24A is a perspective view of a conventional fan when viewed from the exhaust side.
Figure 24B:
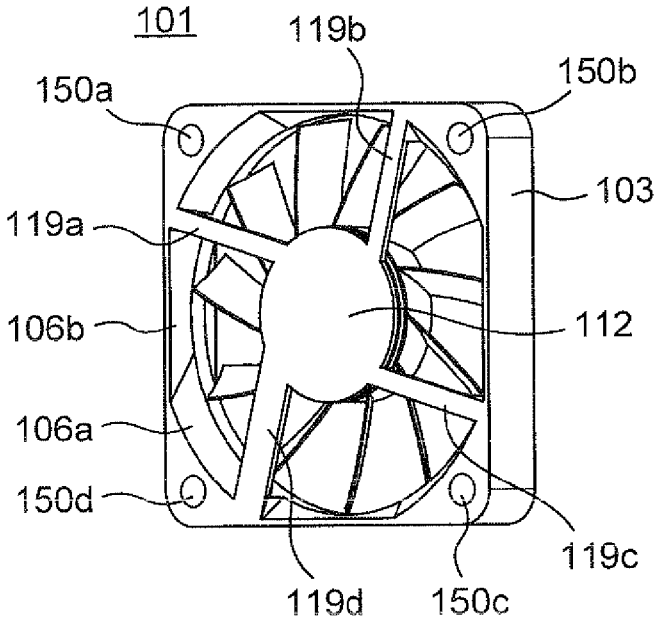
PRIOR ART Fig.24B
FIG. 24B is a perspective view of a conventional fan when viewed from the suction side.
Figure 25A:
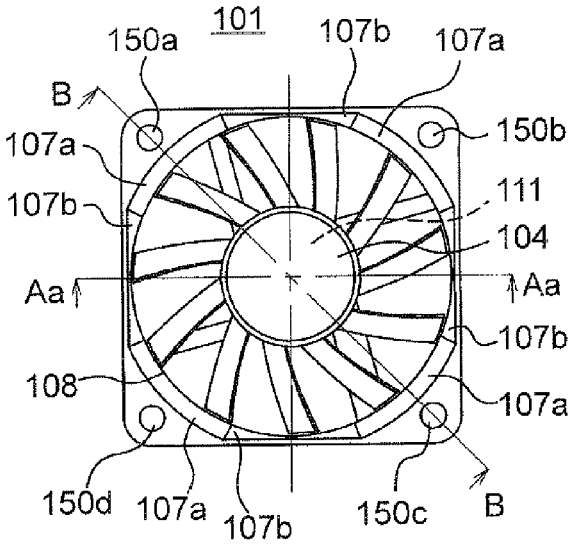
PRIOR ART Fig.25A
FIG. 25A is a plan view of a conventional fan when viewed from the exhaust side.
Figure 25B:
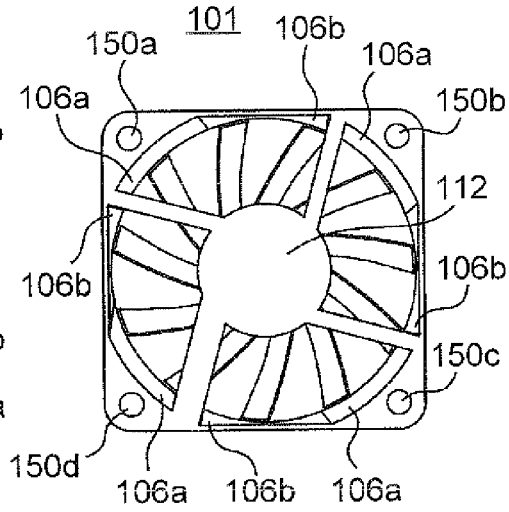
PRIOR ART Fig.25B
FIG. 25B is a plan view of a conventional fan when viewed from the suction side.
Figure 25C:
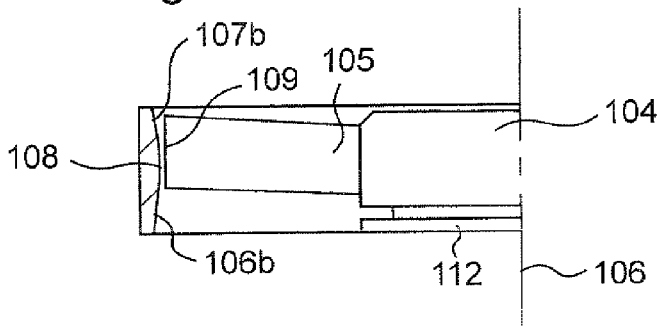
PRIOR ART Fig.25C
FIG. 25C is a partial cross-section view taken along line Aa-Aa of the fan shown in FIG. 25A.
Figure 25D:
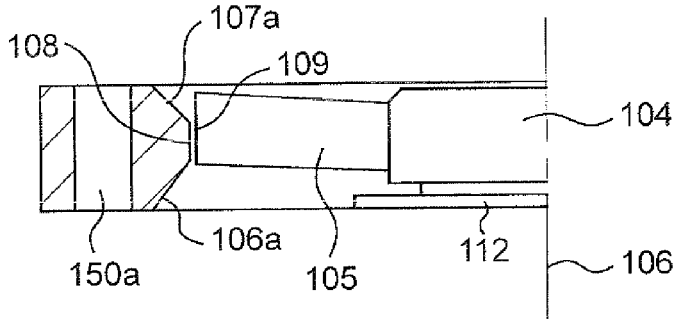
PRIOR ART Fig.25D
FIG. 25D is a partial cross-section view taken along line B-B of the fan shown in FIG. 25A.

In the fourth embodiment of the present invention, the cross-section shapes of the air duct 82z and the air flow guiding plate 81z are formed as shown in FIG. 20D, but the present invention is not limited to this constitution. For example, as shown in FIG. 21, the cross-section shape of the air duct 82x can be parallel to the rotation axis 6, the cross-section shape of the air flow guiding plate 81x can be parallel to a surface which is orthogonal to the rotation axis 6, and a fillet 92 can be provided between the air duct 82x and the air flow guiding plate 81x. Further, as shown in FIG. 22, the cross-section shape of the air flow guiding plate 81x can be inclined relative to the rotation axis 6, and a chamfered portion 89 can be provided between the outer edge 9 and the front edge 7 of the blades 5. As shown in FIG. 23, the air flow guiding plate 81x and the front edge 7 of the blades 5 can be disposed on a substantially identical flat surface which is orthogonal to the rotation axis 6, and the outer edge 9 of the blades 5 can be formed so that its distance from the rotation axis 6 expands from the suction side toward the exhaust side. In this case, a gap between the air flow guiding plate 81x and the blades 5 is at a minimum at a portion near the front edge 7 in the outer edge 9 of the blades 5, and the diameter of the suction inlet 17 is smaller than an outermost diameter of the outer edge 9 of the blades.

It is noted that by appropriately combining arbitrary embodiments among the various embodiments above, it is possible to obtain effects of the respective embodiments.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The fan according to the present invention and the electronic device equipped with the fan can suppress reductions in air flow and secure the necessary exhaust flow amount, even if obstructions such as a chassis, parts, and boards of the electronic device are disposed near the portion of the fan on the suction side. Therefore, the present invention is useful as an electronic device for which miniaturization or thinning is required (for example, plasma display panels, liquid crystal display panels, and the like), and as a fan mounted within such an electronic device which exhausts air within the electronic device.

The invention claimed is:

1. A fan comprising:

an impeller having a plurality of propeller-shaped blades;

a motor configured to rotate the impeller;

an air duct having a first end, a second end, and an exhaust outlet, the exhaust outlet being larger than an outer diameter of a rotation trajectory of the blades of the impeller on the first end;

an air flow guiding plate partially blocking an opening on the second end of the air duct;

a motor-base configured to support the motor; and a plurality of connecting strips configured to connect and fix the motor-base to the air flow guiding plate, wherein the motor-base and the connecting strips are disposed on a suction inlet side of the fan, and wherein a portion of the connecting strips and the motor-base are disposed away from the blades compared with the air flow guiding plate.

2. The fan according to claim 1, wherein the air duct comprises a first region located adjacent an outer edge of the blades, and a second region located away from the outer edge of the blades compared to the first region.

3. A fan comprising:

an impeller having a plurality of propeller-shaped blades;

a motor configured to rotate the impeller;

an air duct having a first end, a second end, and an exhaust outlet, the exhaust outlet being larger than an outer diameter of a rotation trajectory of the blades of the impeller on the first end; and an air flow guiding plate partially blocking an opening on the second end of the air duct, wherein the blades are closer to the air flow guiding plate than the air duct, the air flow guiding plate has an inclined inner edge portion which inclines to approach a rotation axis of the impeller as the air flow guiding plate separates from an exhaust side of the blades in a rotation axis direction of the impeller, a chamfered portion which inclines corresponding to an inclination of the inclined inner edge portion is disposed on the blades in a position facing an inner surface of the inclined inner edge portion, and the air flow guiding plate and the blades are disposed such that a gap between the air flow guiding plate and the blades is smallest between the inclined inner edge portion and the chamfered portion.

4. A fan comprising:

an impeller having a plurality of propeller-shaped blades;

a motor configured to rotate the impeller;

an air duct having a first end, a second end, and an exhaust outlet, the exhaust outlet being larger than an outer diameter of a rotation trajectory of the blades of the impeller on the first end; and an air flow guiding plate partially blocking an opening on the second end of the air duct, wherein the blades are closer to the air flow guiding plate than the air duct, the impeller has a substantially cylindrical hub, the blades being attached on a side surface of the hub, and a portion of the impeller on an exhaust outlet side further comprises a disc attached centered on a rotation axis of the impeller, a diameter of the disc being larger than an outer diameter of the hub and smaller than an outermost diameter of the rotation trajectory of the blades.

5. An electronic device, comprising the fan according to claim 4 disposed and built in an outer wall, wherein an exhaust hole is formed on the outer wall in a region facing the exhaust outlet of the fan.

6. An electronic device comprising:

a first wall which is an outer wall of the electronic device;

a second wall facing the first wall;

a fan disposed inside the first wall and having an exhaust portion, the exhaust portion of the fan being disposed adjacent the first wall, and a suction portion of the fan being disposed adjacent the second wall; and a circuit board arranged so as to be cooled by the fan, and being disposed laterally to a clearance between the second wall and the suction portion of the fan, wherein the fan comprises an impeller having a plurality of propeller-shaped blades, a motor configured to rotate the impeller, an air duct having a first end, a second end, and an exhaust outlet, the exhaust outlet being larger than an outer diameter of a rotation trajectory of the blades of the impeller on the first end, an air flow guiding plate partially blocking an opening on the second end of the air duct, a motor-base configured to support the motor, and a plurality of connecting strips configured to connect and fix the motor-base to the air flow guiding plate, and wherein the motor-base and the connecting strips are disposed on a suction inlet side of the fan.

7. The electronic device according to claim 6, wherein the impeller has a substantially cylindrical hub, the blades being attached on a side surface of the hub, and an inner diameter of the suction inlet disposed on the air flow guiding plate is smaller than an outer diameter of a rotation trajectory of the blades and larger than an intermediate diameter of the outer diameter of the rotation trajectory of the blades and an outer diameter of the hub.

8. The electronic device according to claim 6, wherein the impeller has a substantially cylindrical hub, the blades attaching on a side surface of the hub, and an exhaust hole is disposed on the first wall in a region on an outside of a regulation circle which has a diameter that is larger than an outer diameter of the hub and smaller than the exhaust outlet, centered on a position corresponding to a rotation axis of the impeller.

9. The electronic device according to claim 6, wherein an exhaust hole is disposed on the first wall in a region facing the exhaust outlet of the fan.

10. An electronic device comprising:

a first wall which is an outer wall of the electronic device;

a second wall facing the first wall;

a fan disposed inside the first wall and having an exhaust portion, the exhaust portion of the fan being disposed adjacent the first wall, and a suction portion of the fan being disposed adjacent the second wall; and a circuit board arranged so as to be cooled by the fan, and being disposed lateral to a clearance between the second wall and the suction portion of the fan, the fan comprising an impeller having a plurality of propeller-shaped blades, a motor configured to rotate the impeller, an air duct having a first end, a second end, and an exhaust outlet, the exhaust outlet being larger than an outer diameter of a rotation trajectory of the blades of the impeller on the first end, and an air flow guiding plate partially blocking an opening disposed on the second end of the air duct, the air flow guiding plate having an inclined inner edge portion which inclines to approach a rotation axis of the impeller as the air flow guiding plate separates from an exhaust side of the blades in a rotation axis direction of the impeller, wherein the fan is configured to inhale heat from the circuit board via an outer side of the inclined air flow guiding plate.

11. An electronic device comprising:

a first wall which is an outer wall of the electronic device;

a second wall facing the first wall;

a fan disposed inside the first wall, and having an exhaust portion, the exhaust portion of the fan being disposed adjacent the first wall, and a suction portion of the fan being disposed adjacent the second wall; and a circuit board arranged so as to be cooled by the fan, and being disposed lateral to a clearance between the second wall and the suction portion of the fan, the fan comprising an impeller having a plurality of propeller-shaped blades, a motor configured to rotate the impeller, an air duct having a first end, a second end, and an exhaust outlet, the exhaust outlet being larger than an outer diameter of a rotation trajectory of the blades of the impeller on the first end, and an air flow guiding plate partially blocking an opening on the second end of the air duct, wherein the fan is configured to inhale heat from the circuit board via an outer side of the inclined air flow guiding plate.

12. A fan comprising:

an impeller having a plurality of propeller-shaped blades, a motor configured to rotate the impeller, an air duct having a first end, a second end, and an exhaust outlet, the exhaust outlet being larger than an outer diameter of a rotation trajectory of the blades of the impeller on the first end, the air duct having an inclined inner edge portion which inclines to approach a rotation axis of the impeller as the air duct separates from an exhaust side of the fan, and an air flow guiding plate partially blocking an opening on the second end of the air duct, wherein the fan is configured to guide air in an outer surface side of the air duct to a suction portion of the fan via an outer surface of the air flow guiding plate.

* * * * *